US012757993B2

(12) United States Patent
English et al.

(10) Patent No.: US 12,757,993 B2
(45) Date of Patent: Oct. 13, 2026

(54) HAIR CURLER

(71) Applicant: SharkNinja Operating LLC, Needham, MA (US)

(72) Inventors: Stephanie Vlasta English, Rugby (GB); Dominic Stenton, Newcastle (GB); Benjamin Thorpe, Bracknell (GB); Olivia Louise Parsons, Boston, MA (US)

(73) Assignee: SharkNinja Operating LLC, Needham, MA (US)

( * ) Notice: Subject to any disclaimer, the term of this patent is extended or adjusted under 35 U.S.C. 154(b) by 398 days.

(21) Appl. No.: 18/316,652

(22) Filed: May 12, 2023

(65) Prior Publication Data

US 2024/0374008 A1 Nov. 14, 2024

(51) Int. Cl.
*A45D 2/06* (2006.01)

(52) U.S. Cl.
CPC ..... *A45D 2/06* (2013.01)

(58) Field of Classification Search
CPC ... A45D 2/02; A45D 2/06; A45D 2/08; A45D 2/10; A45D 2/12; A45D 2/14; A45D 2/20; A45D 2/24; A45D 2/122; A45D 2/125; A45D 2/127; A45D 2/141; A45D 2/148; A45D 2002/025; A45D 8/38; A45D 8/002; A45D 8/004; A45D 8/36; A45D 8/12; A45D 8/14; A45D 8/00
See application file for complete search history.

(56) References Cited

U.S. PATENT DOCUMENTS 2,430,766 A * 11/1947 Gregory ..... A45D 2/10 132/245
2,611,377 A * 9/1952 Barnes ..... A45D 2/10 132/332
2,698,623 A * 1/1955 Hahn ..... A45D 2/10 132/266
2,713,864 A * 7/1955 Solomon ..... A45D 2/02 D28/37

(Continued)

FOREIGN PATENT DOCUMENTS

CN 106579712 A 4/2017
CN 108175167 B 5/2020

(Continued)

OTHER PUBLICATIONS

Clarivate Analytics copyrighted translation of KR20170129458A; publication date Nov. 27, 2017 (Year: 2017).*

(Continued)

*Primary Examiner* — Edelmira Bosques
*Assistant Examiner* — Sarah Woodhouse
(74) *Attorney, Agent, or Firm* — Mintz, Levin, Cohn, Ferris, Glovsky and Popeo, P.C.

(57) ABSTRACT

A hair curler is provided and can include a cap having a central opening and a shield arranged around the central opening. The hair curler can also include a base having an annular collar with a central opening therein and a flange extending radially from the annular collar. The flange can be configured to mate with the shield such that the base and the cap enclose the entrapment area and such that the central opening in the cap can be aligned with the central opening in the base. Related styling assemblies and methods of use are also provided.

21 Claims, 27 Drawing Sheets

(56) References Cited

U.S. PATENT DOCUMENTS

| | | | | |
|---|---|---|---|---|
| 2,781,047 | A * | 2/1957 | Whitehill | A45D 2/10 132/332 |
| 2,789,565 | A | 4/1957 | Voorhees | |
| 3,618,620 | A * | 11/1971 | Williams | A45D 2/10 132/212 |
| 5,033,487 | A * | 7/1991 | Barradas | A45D 2/20 132/265 |
| 5,573,016 | A | 11/1996 | Graves | |
| 5,771,906 | A | 6/1998 | De Benedictis | |
| 6,363,946 | B1 * | 4/2002 | Sumner | A45D 2/2457 132/265 |
| D742,067 | S | 10/2015 | James | |
| 9,185,957 | B2 | 11/2015 | Richmond et al. | |
| 9,433,273 | B2 | 9/2016 | Kock | |
| 10,285,481 | B2 | 5/2019 | Bonnemaire et al. | |
| 10,485,317 | B2 | 11/2019 | Debenedictis et al. | |
| 10,537,162 | B2 | 1/2020 | Yeung | |
| 10,602,824 | B2 | 3/2020 | Leung | |
| 11,000,103 | B2 | 5/2021 | Grienay et al. | |
| 11,134,764 | B2 | 10/2021 | Xiao et al. | |
| 11,224,274 | B2 | 1/2022 | Kim et al. | |
| 11,350,719 | B2 | 6/2022 | Debenedictis | |
| 11,399,610 | B2 | 8/2022 | Davis et al. | |
| 11,517,089 | B2 | 12/2022 | Dolah | |
| 2004/0134508 | A1 * | 7/2004 | Catini | A45D 2/10 132/265 |
| 2008/0236610 | A1 * | 10/2008 | Bartels | A45D 2/10 132/226 |
| 2019/0142128 | A1 * | 5/2019 | Davis | A45D 20/12 132/203 |
| 2019/0183224 | A1 | 6/2019 | Sunderland | |
| 2020/0163428 | A1 | 5/2020 | Fernandez et al. | |
| 2020/0196728 | A1 | 6/2020 | Yong et al. | |
| 2021/0196020 | A1 | 7/2021 | Sunderland et al. | |
| 2021/0212430 | A1 | 7/2021 | Sunderland et al. | |
| 2021/0244151 | A1 | 8/2021 | Chu | |
| 2022/0039530 | A1 | 2/2022 | Ahrens | |

FOREIGN PATENT DOCUMENTS

| | | | |
|---|---|---|---|
| CN | 111374420 | A | 7/2020 |
| CN | 111657654 | A | 9/2020 |
| EP | 3100633 | B2 | 3/2022 |
| WO | 2022158808 | A1 | 7/2022 |

OTHER PUBLICATIONS

International Search Report and Written Opinion received for PCT Patent Application No. PCT/US2024/024918, mailed on Jun. 21, 2024, 14 pages.

* cited by examiner

HAIR CURLER

FIELD

A hair curler is provided for use with a hair care appliance.

BACKGROUND

Hair curlers are devices used for styling of hair. Hair curlers can receive hair to be curled and can provide a surface for forming a curl in a user's hair. Hair curlers can retain the hair and the hair curler can remain coupled with a user's hair for a period of time to set or impart permanency of the curl in the hair.

SUMMARY

In general, a hair pod configured for curling hair is provided and in one embodiment can include a cap having a central opening and a shield arranged around the central opening. The shield can have a first portion extending radially outward from the central opening and a second portion extending substantially parallel to a longitudinal axis of the central opening such that the first and second portions define an entrapment area. The hair pod can also include a base having an annular collar with an irregular shaped central opening therein and a flange extending radially from the annular collar. The flange can be configured to mate with the shield such that the base and the cap can enclose the entrapment area and such that the central opening in the cap can be aligned with the central opening in the base.

In one embodiment, the shield can comprise a plurality of arms. In another embodiment, each of the plurality of arms can have a notch formed on an inner surface thereof configured to seat with the flange of the base. In another embodiment, the cap can include a cylindrical housing defining the central opening. The cylindrical housing can extend into the entrapment area.

In one embodiment, the flange can include a plurality of flange projections extending from the flange into the entrapment area. In another embodiment, the plurality of flange projections can include a first plurality of flange projections having a first height and a second plurality of flange projections having a second height. The second height can be greater than the first height. In another embodiment, the shield can include a plurality of shield projections extending from the shield toward the annular collar of the base and into an upper portion of the entrapment area. In another embodiment, the shield can be configured to extend around and frictionally engage an outer surface of the flange.

In another embodiment, the base can be formed from a heat-resistant material. In one embodiment, the central opening in the base can include a plurality of adjoining segments. In another embodiment, the plurality of adjoining segments can form a circumferential shaped central opening.

In another aspect, a hair pod configured for use curling hair is provided and in one embodiment can include a cap having a hollow cylindrical housing and a shield extending radially around the hollow cylindrical housing to define an entrapment area therebetween. The hair pod can also include a base configured to mate with the shield and having an annular collar with a central opening and a flange disposed radially therearound. The collar can include a plurality of adjoining segments defining the central opening and configured to slidably engage with a shaft of a curler. The plurality of adjoining segments can include a first set of segments offset from a second set of segments.

In some aspects, the shield can include an annular notch on an inner surface thereof configured to frictionally engage the flange to mate the base to the cap. In another embodiment, the shield can include a plurality of arms spaced radially around the hollow cylindrical housing. In some embodiments, the plurality of arms can include an overmolded portion configured to retain the hair pod within hair. In another embodiment, the first set of segments can be oriented in a first rotational direction and the second set of segments can be oriented in a second rotational direction, opposite the first rotational direction of the first set of segments. In some embodiments, the shield can be concave.

In another aspect, a styling assembly for curling hair is provided and in one embodiment can include a curler having an elongate shaft configured to receive hair therearound, and an end cap projecting from an end of the elongate shaft. The styling assembly can also include a pod. The pod can have an annular base having a central opening configured to slidably receive the elongate shaft of the curler. The pod can also include a cap having a hollow cylindrical housing configured to receive the end cap, and a shield extending radially outward from the hollow cylindrical housing and configured to mate with the annular base such that the shield and the annular base define a hollow chamber therebetween.

In another embodiment, the hollow cylindrical housing can be configured to frictionally engage the end cap of the curler. In some embodiments, the shield can include a plurality of arms configured to engage a first flange on the annular base via an interference fit. In some embodiments, a terminal end of each arm of the plurality of arms can be configure to abut a second flange on the annular base. In some embodiments, the central opening of the annular base can include a plurality of adjoining segments.

In another embodiment, the curler can include a first curler having a first plurality of adjoining segments extending radially around the elongate shaft of the first curler in a first rotational direction, or a second curler having a second plurality of adjoining segments extending radially around the elongate shaft of the second curler in a second rotational direction opposite to the first rotational direction. In some embodiments, the central opening of the annular base can include a first set of segments offset from a second set of segments, and the first set of segments can be configured to slidably receive the elongate shaft of the first curler and the second set of segments can be configured to slidably receive the elongate shaft of the second curler.

In another aspect, a method for curling hair is provided and in one embodiment can include wrapping a portion of hair around a curler shaft. The method can also include advancing a base disposed around the curler shaft longitudinally along the curler shaft to advance the wrapped portion of hair into a cap mounted on an end of the curler shaft, and to push the base into engagement with the cap such that the portion of hair is retained between the cap and the base. The method can further include advancing the cap and the base off of the curler shaft with the portion of hair retained therebetween.

In some embodiments, the base can have a central opening and a plurality of adjoining segments arranged within the central opening, and the curler shaft can be included on a first curler having a first plurality of adjoining segments extending radially around the curler shaft in a first rotational direction. The method can further include, prior to wrapping, advancing the base over an end of the curler shaft. In some embodiments, the method can also include, after advancing the cap and the base with the portion of hair retained therebetween off of the first curler shaft, removing the cap from the base and advancing the base over a second curler shaft. The second curler shaft having a second plurality of adjoining segments extending radially around the second curler shaft in a second rotational direction opposite the first rotational direction of the first curler shaft. In another embodiment, the method can further include leaving the portion of hair retained between the cap and the base for a pre-determined period of time after advancing the cap and base with the portion of the hair retained therebetween off of the curler shaft.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary hair curlers for use with a hair care appliance, such as a hair dryer, and/or an attachment thereof are provided herein. The hair curlers address a number of shortcomings of existing hair curlers. For example, existing hair curlers may be challenging to place hair within the hair curler, and once placed therein, may not adequately secure hair onto the hair curler causing it to fall out of the user's hair. Some hair curlers can be bulky, awkwardly shaped, or can include clips or locking mechanisms which can be difficult to manually manipulate. It can be challenging to easily place hair curlers in desired locations close to the roots of hair or in difficult to reach locations, such as in hair located at the back of the user's head. Clips can be required to maintain a hair curler at a desired location and the clips can be easily lost or misplaced. Some hair curlers require the user sleep with the hair curlers in place in order to form a long-lasting, well-formed curl. The material of the hair curler can also affect the curl produced and ease of use of the hair curler. For example, curlers that include a Velcro material can cause hair to be entrapped therein during application or removal.

Some hair curlers are heated in order to form or set a curl in hair and can burn the user's hand or scalp if not handled properly. It can be difficult to easily remove the hair curler without ruining the newly created curl. When curling hair via a dedicated curling device or a curling attachment of a hair care appliance, it can be difficult to keep hair wrapped around a barrel of the device or attachment. The improved hair curler described herein addresses these shortcomings.

Figures 17A, 17B:
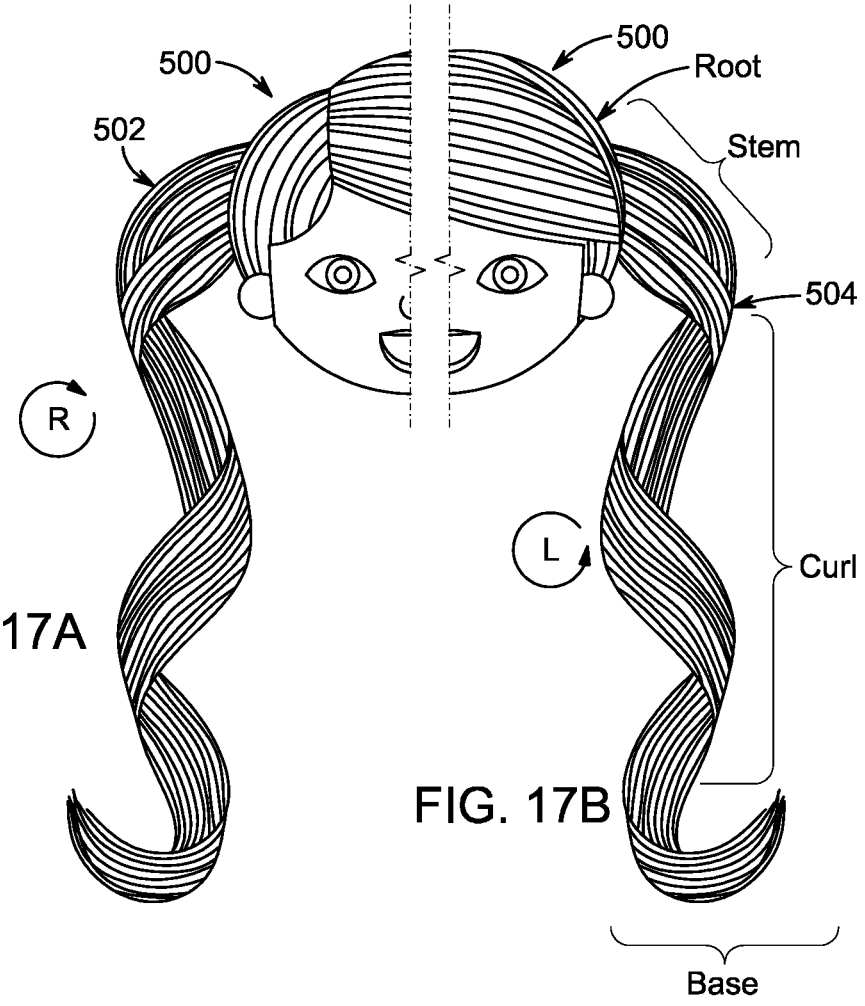
FIG. 17A is an image showing curls having a right-handed direction formed by embodiments of the hair pods and styling assemblies described herein.
FIG. 17B is an image showing curls having a left-handed direction formed by embodiments of the hair pods and styling assemblies described herein.

Creating a well-formed, long-lasting curl can require particular skill to perform. A number of factors can determine the shape, volume, and longevity of a curl. A curl can include a stem portion, a curl portion, and a base portion as shown in FIG. 17B. The stem portion of the curl can be a length or an amount of hair extending from the roots of the hair to the first arc of a first curl. The stem can be important as it can determine the direction of a curl, and the volume of the curl. The volume of the curl can be based on what direction the hair is wrapped around the curler. The curl portion can be the portion of hair that wraps around the hair curler. The size of the curl can correspond to the size of the hair curler that is applied. A bigger hair curler will impart a larger curl. The base portion of the curl can be a distance from last curl of the curl portion to the base of the curler. Ideally, the base portion will not be longer than the diameter of the hair curler or else the curls will be created further away from the roots resulting in lower volume, poorly formed curls. Placing the hair curler close to the roots of the hair can form higher volume, more robust curls. The hair pod described herein has a number of design features configured to improve the shape, size, location, and permanency of curls.

In one embodiment, a hair pod is provided. The hair pod can be configured for use with a hair curler having a shaft around which hair can be wrapped for curling. The hair pod can include a cap that can mate with an end (or end cap) of the hair curler and a base that can slide along a shaft of the hair curler. A user can position the base onto the shaft of the hair curler and can place the cap onto the end of the hair curler. The user can wrap hair around the shaft of the hair curler in between the cap and the base to initiate curling of the hair. The base can be slidably advanced along the shaft to mate with the cap. The wrapped hair can be retained between the cap and the base within a chamber or entrapment area formed between the cap and the base. A user can then remove the hair pod retaining the hair therein from the hair curler. The user can leave the hair pod attached to their hair for a period of time to set the curl formed via the hair pod.

The hair pod described herein can provide a number of advantages over existing hair curlers. For example, the hair pod includes a low-profile, compact design which is visually appealing, sleek, and easily-handled for curling hair. Because the hair pod is configured for attachment to a shaft of a hair curling device, it is more efficient to use than other curling devices and methods which require use of a hair curling device to first curl a user's hair and subsequent insertion and placement of a hair curler to hold and set the curled hair. The hair pod described herein can advantageously be placed closer to the scalp to create better-formed curls along an entire length of hair than existing hair curlers. The convenient coupling of the cap and base make capturing hair within the hair pod easier than other hair curler designs which can require clips or complicated fixing means to retain hair with respect to a hair curler. In addition, one or more portions of the hair pod described herein include heat-resistant materials to protect a user's hand and/or scalp from accidental burns. Advantageously, these features can provide an enhanced styling experience, particularly for producing well-formed curls along the entire length of a user's hair compared to other hair curlers.

FIGS. 1A-9 illustrate exemplary embodiments of a hair pod configured for detachable coupling with a hair curler. In one embodiment, shown in FIGS. 1A-4, a hair pod 100 is provided having a cap 102 and a base 104. The illustrated cap 102 is a generally concave structure with a central cylindrical housing 110 having a central opening 106 extending therethrough, and a shield 116 arranged around the cylindrical housing 110. The base 104 is an annular structure and having a central opening 108 configured to slidably receive a curler device.

Figure 1A:
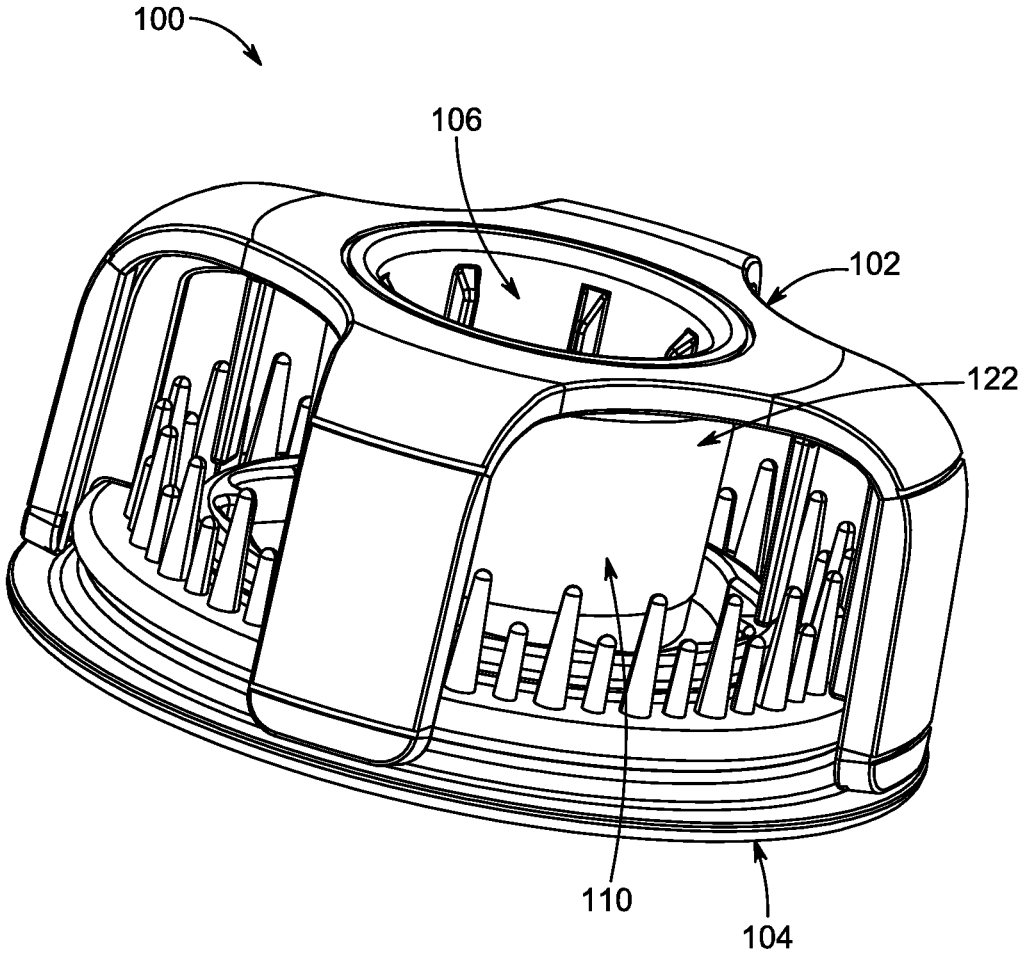
FIG. 1A is a top-side perspective view of one exemplary embodiment of a hair pod.
Figure 1B:
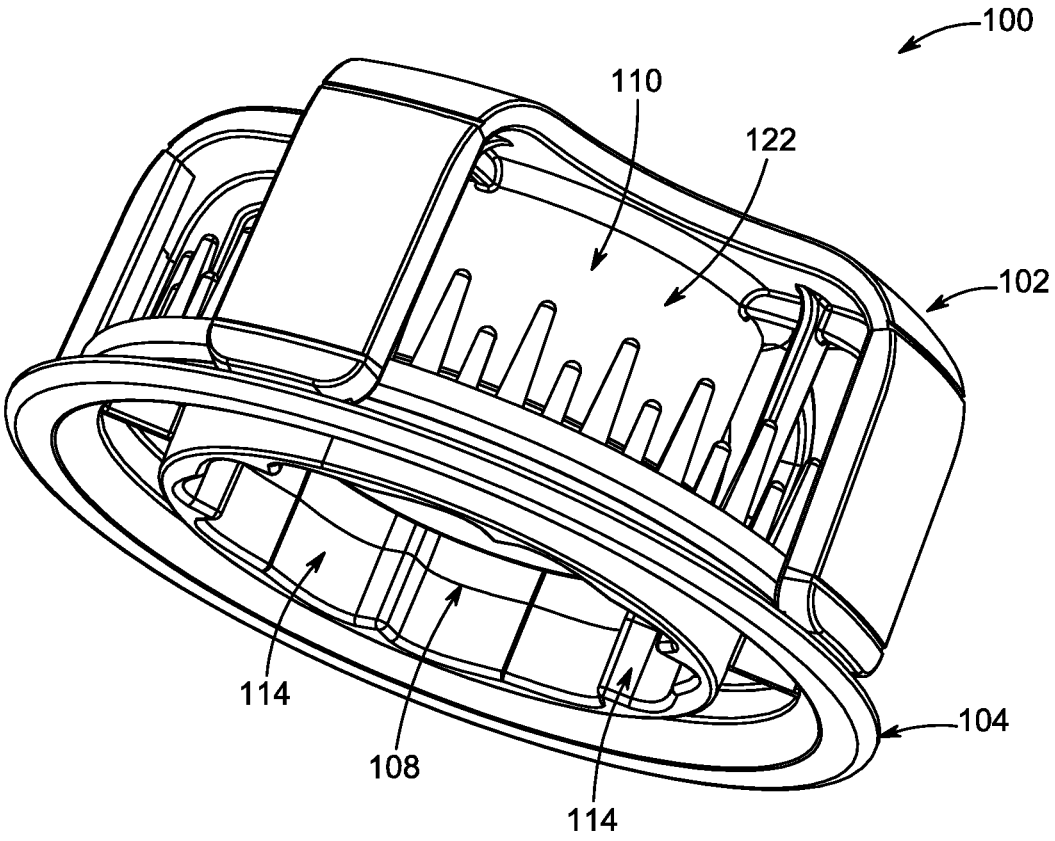
FIG. 1B is a bottom-side perspective view of the hair pod of FIG. 1A.
Figure 2A:
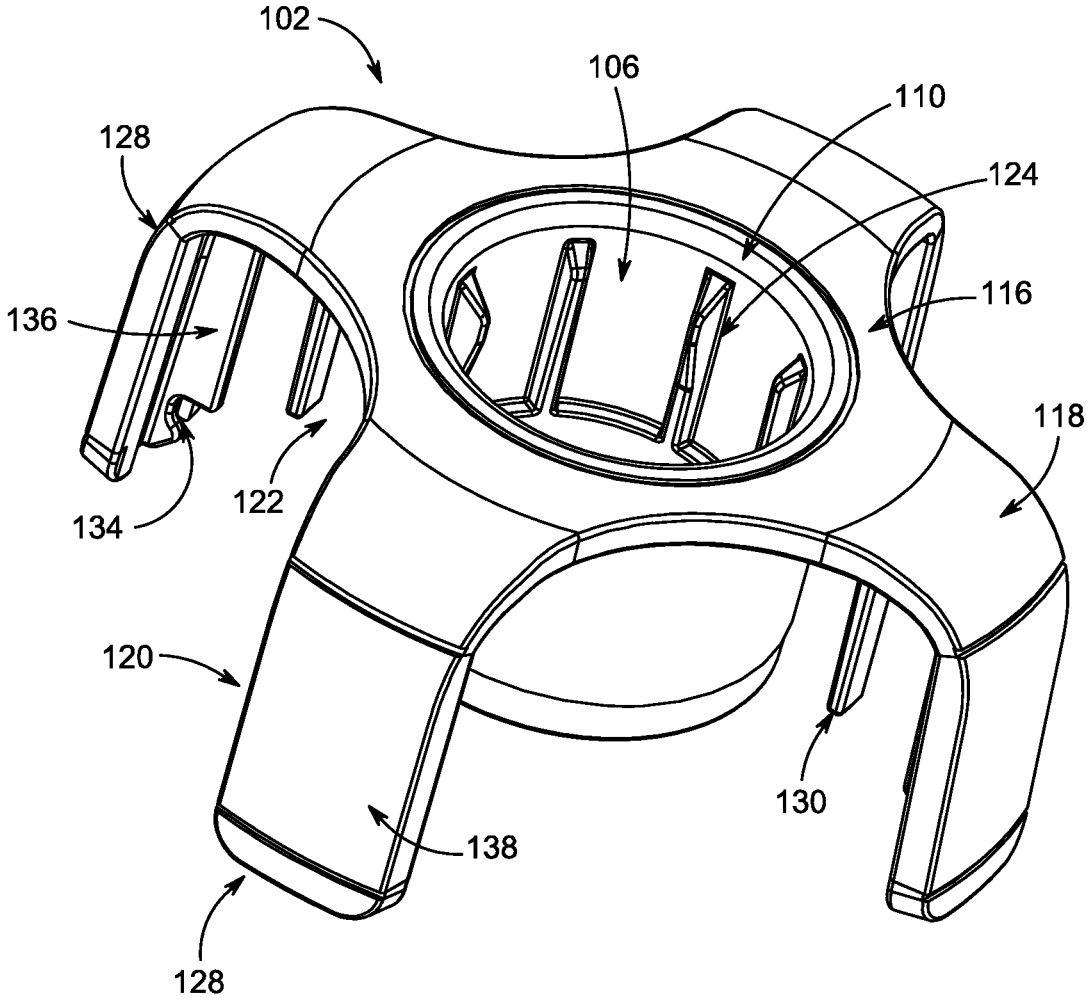
FIG. 2A is a top-side perspective view of a cap of the hair pod of FIGS. 1A-1B.
Figure 2B:
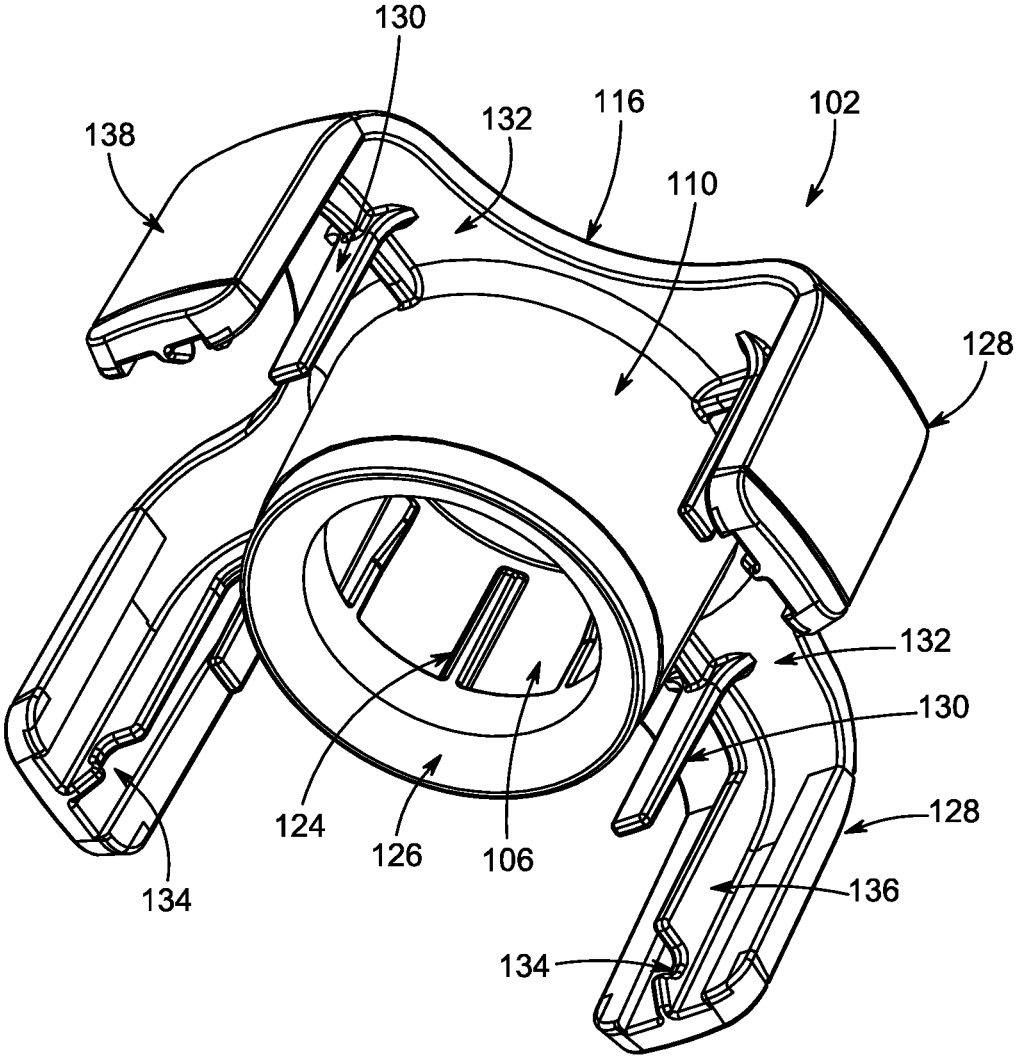
FIG. 2B is a bottom-side perspective view of the cap of FIG. 2A.

As shown in more detail in FIG. 2A, the cylindrical housing 110 of the cap 102 can include a plurality of ribs 124 arranged longitudinally along the inner surface thereof. The cylindrical housing 110 can be configured to slidably couple with an end cap of a hair curler as will be described later. The housing 110 can include a high-friction material overmolded atop the housing 110 to retain the housing 110 on the end cap of the hair curler. In some embodiments, the high-friction material can include a thermoplastic elastomer. In some embodiments, the thermoplastic elastomer can have a Shore hardness of 55-65 on the durometer scale. The lower portion of the cylindrical housing 110, as shown in FIG. 2B, can include a beveled edge 126 to improve the ease of coupling the cap 102 to the end cap of a hair curler.

The shield 116 can be arranged around the central opening 106. The shield 116 can have various configurations, but in the illustrated embodiment the shield 116 has a plurality of arms 128 extending radially from the central opening 106 that together define a generally concave inner cavity or entrapment area 122. Although the embodiment of FIGS. 1A-4 illustrate a shield 116 having 4 radially extending arms, more or less arms 128 can be envisioned. The shield 116 (and arms 128) can include a first portion 118 extending radially outward from the central opening 106 and a second portion 120 extending substantially parallel to a longitudinal axis extending through the central opening 106. In other words, each arm 128 can be curved or in the form of a rounded L-shape.

In some embodiments, the shield 116 can include a plurality of shield projections 130 extending from the inferior surface 132 of the first portion 118 of the shield 116 toward the base. The shield projections 130 can extend into the entrapment area 122 and toward the base 104. In this way, the shield projections 130 can contact hair within the entrapment area 122 and improve the ability of the hair pod 100 to hold hair therein for curling.

The second portion 120 of the shield 116 can include a notch 134 configured in a support 136 that extends radially inward from the inferior surface 132 of the shield 116 toward the cylindrical housing 110. The support 138 can extend along the length of the arms 128 and can be configured to provide support to the arms 128. The notch 134 can have an annular shape and can be configured to mate, via friction fit or inference fit, with a flange of the base 104 as will be described later.

Each of the arms 128 can include an overmolded portion 138 surrounding the second portion 120 of the shield 116. In some embodiments, the overmolded portion 138 can include a high-friction material overmolded atop the second portion 120 of the shield 116 (e.g., at the lower end of the arm 128). In some embodiments, the overmolded portion 138 can be formed on, partially around, or fully around the second portion 120. The high-friction surface of the overmolded portion 138 can help to retain the hair pod 100 close to the scalp of a user for tighter, more well-formed curls and can also provide a high-friction surface to engage an end of the hair that is retained within the entrapment area 122. In this way, the hair pod 100 can advantageously provide a more secure engagement with a user's hair to improve the shape of curls. In some embodiments, the high-friction material can include a thermoplastic elastomer. In some embodiments, the thermoplastic elastomer can have a Shore hardness of 55-65 on the durometer scale.

As indicated above, the hair pod 100 can also include a base 104 configured to mate with the cap 102. As shown in detail in FIGS. 3A-3B, the base 104 can have an annular shape with a central collar 140 defining a central opening 108. In some embodiment, the inferior surface 158 of the base 104 can be hollowed out (as shown) for weight reduction. In some embodiments, the inferior surface 158 may not be hollowed out and can be substantially planar across its diameter. In some embodiments, one or more portions of the base 104 can include a heat-resistant material to protect a user's hands or scalp when using the hair pods described herein.

A flange 142 can extend radially outward from the collar 140 and can include a plurality of flange projections 148 extending from an upper surface of the flange 142 into the entrapment area 122. The plurality of flange projections 148 can include a first set of flange projections 144 and a second set of flange projections 146 interleaved with the first set of flange projections 144. The first set of flange projections 144 can have a height that is greater than the second set of flange projections 146 or vice versa. In some embodiments, the height of the flange projections 148 can be equal. In some embodiments, the number, spacing, or arrangement of flange projections 148 can vary from the number, spacing, or arrangement shown in FIGS. 3A-3B.

The base 104 can also include a second flange 150 positioned below and extending from the flange 142. An upper surface 152 of the second flange 150 can provide an abutment surface at which terminal ends (e.g., farthest from the cylindrical housing 110) of the arms 128 contact the second flange 150 when the cap 102 is coupled to the base 104.

The central opening 108 in the annular collar 140 can have a variety of shapes and sizes, and the particular configuration can vary depending on the configuration of the curler device that the base is adapted to slide onto. In the illustrated embodiment, the central opening 108 has an irregular or non-circular shape with a plurality of adjoining segments 114 defining an inner surface of the annular collar 140 and forming a circumferential shape of the central opening 108. The plurality of adjoining segments 114 can be configured to prevent rotational slippage or displacement of the base 104 relative to a longitudinal shaft of a hair curler configured for use with embodiments of the hair pod described herein.

Figure 3A:
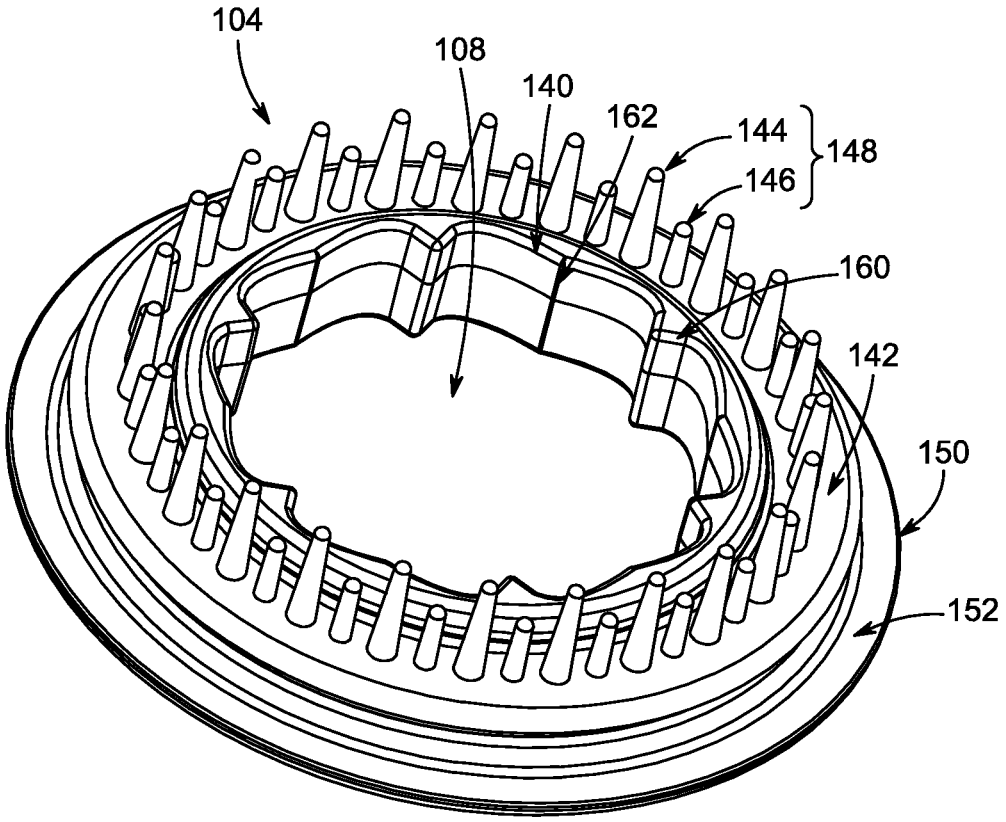
FIG. 3A is a top-side perspective view of a base of the hair pod of FIGS. 1A-1B.
Figure 3B:
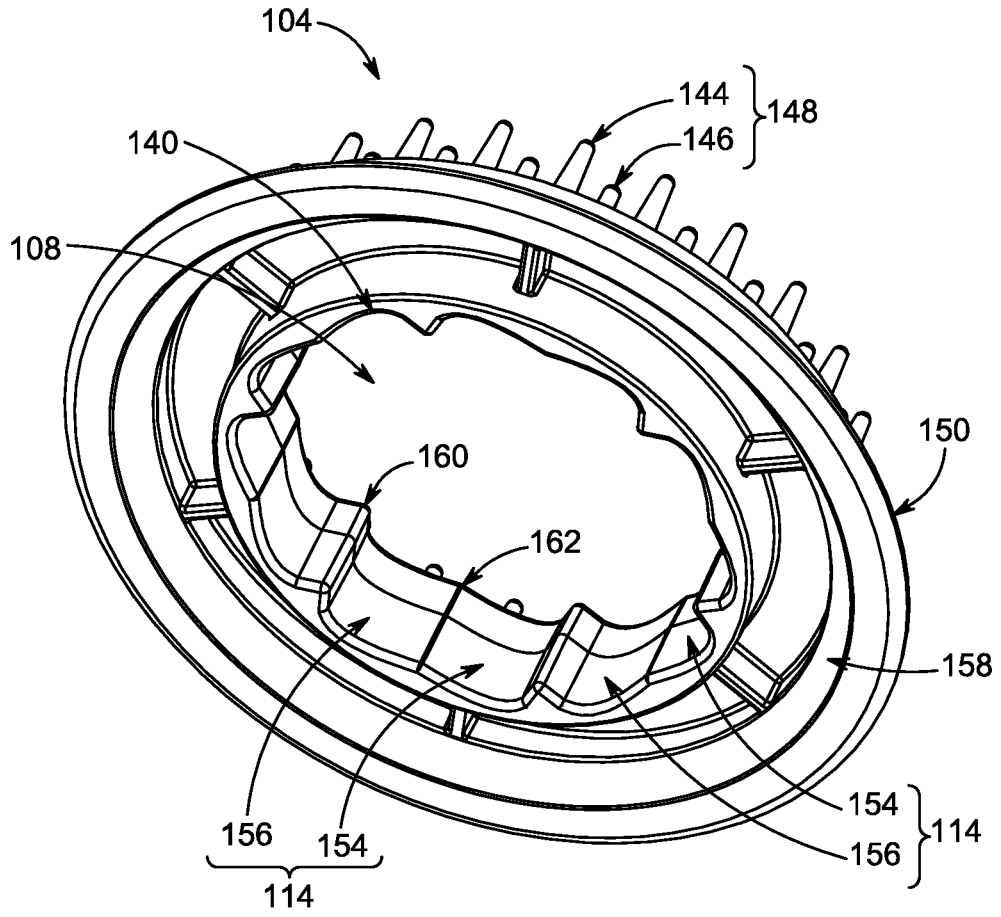
FIG. 3B is a bottom-side perspective view of the base of FIG. 3A.

In the illustrated embodiment, the segments 114 include a first set of segments 154 that are interleaved between a second set of segments 156. The plurality of adjoining segments 114 can be configured to slidably couple with adjoining segments of a hair curler when the base 104 is attached to the hair curler. For example, the first set of segments 154 can be oriented in a first rotational direction that corresponds to a first rotational direction of adjoining segments of a first hair curler (such as a curler having segments oriented in a right-handed or clockwise direction configured to produce right-handed curls). The second set of segments 156 can be oriented in a second rotational direction that corresponds to a second rotational direction of adjoining segments of a second hair curler (such as a hair curler having segments oriented in a left-handed or counter-clockwise direction configured to produce left-handed curls). When viewed in combination, each pair of first and second segments (or left and right segments) are separated by a peak or projection 160 with each segment being in the form of a valley. A smaller peak 162 separates adjacent segments as shown in FIGS. 3A and 3B.

An example of right-handed curls that can be formed using the hair pods and styling assemblies described herein is shown in FIG. 17A. The length of hair 502 extending from the user's head 500 can have a right-handed rotational direction (R) formed using the base 104 of the hair pod 100 coupled to a hair curler 8300 via the first set of adjoining segments 154. As shown in FIG. 17B, the length of hair 504 extending from the user's head 500 can have a left-handed rotational direction (L) formed using the base 104 of the hair pod 100 coupled to the hair curler 8300 via the second set of adjoining segments 156. The right- or left-rotational direction of the curl can be defined relative to a longitudinal axis extending along a portion of hair in which the hair pod described herein is attached. This axis can be defined with respect to any angle along which a user's hair extends from their head.

Advantageously, the arrangement of the adjoining segments 114 enables the hair pod 100 to be coupled ubiquitously with hair curlers having right and left-handed rotational directions without requiring separate hair pods with respective right and left-handed rotational directions. Thus, each hair pod 100 is configured to operate with rotationally different hair curlers thereby reducing the number of curling accessories needed by the user and improving the overall hair curling experience.

Figure 4:
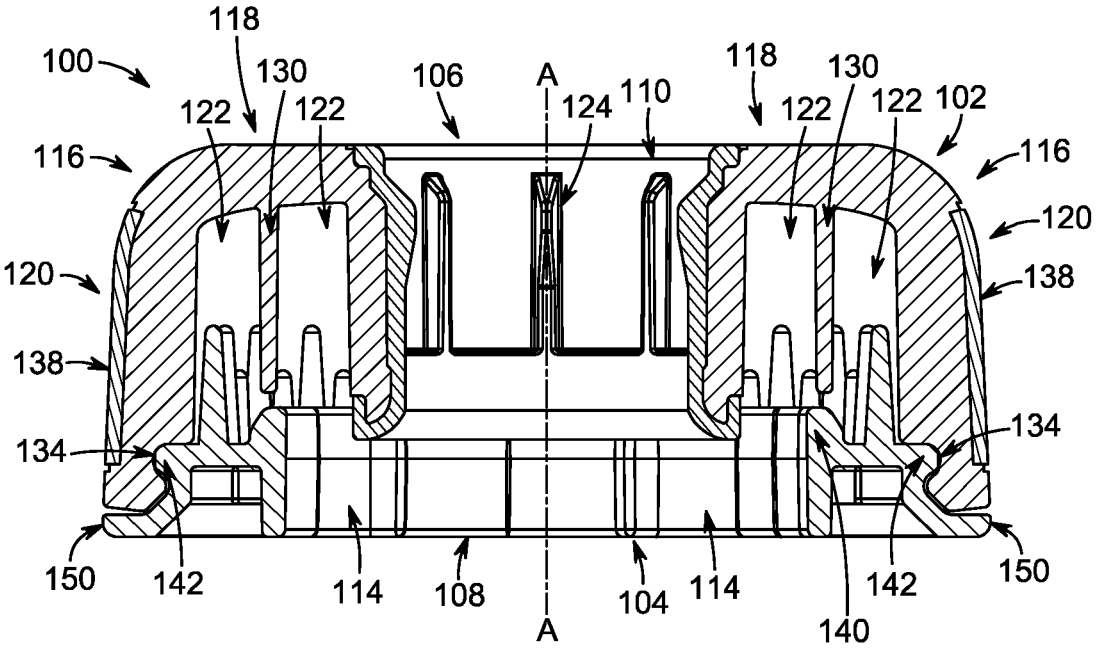
FIG. 4 is a cross-sectional view of the hair pod of FIGS. 1A-1B.

The cap 102 and the base 104 can mate to one another along a central longitudinal axis A of the hair pod 100 that extends through the central opening 108 of the base 104 and through the central opening 106 of the cap 102, as shown in FIG. 4. When coupled, the first portion 118 and the second portion 120 of the cap 102 can form a chamber or entrapment area 122 with the flange 142 where hair can be entrapped therein wrapping around the cylindrical housing 110. The notch 134 located at the terminal end (e.g., farthest from the central opening 106) of the second portion 120 of the shield 116 can receive therein the outer edge of the flange 142. The radius or curvature of the notch 134 can be sized to correspond to the curvature or radius of the outer edge of the flange 142 such that the notch 134 and the flange 142 can couple together via friction fitting or interference fitting. In some embodiments, the notch 134 and the flange 142 can couple together via snap fitting, with the arms flexing as they are advanced over the flange 142. As further shown in FIG. 4, the second portion 120 of the shield 116 can abut or otherwise rest upon the second flange 150 of the base 104 when the cap 102 is coupled with the base 104. This can provide an additional measure of support for the hair pod 100.

Figure 5A:
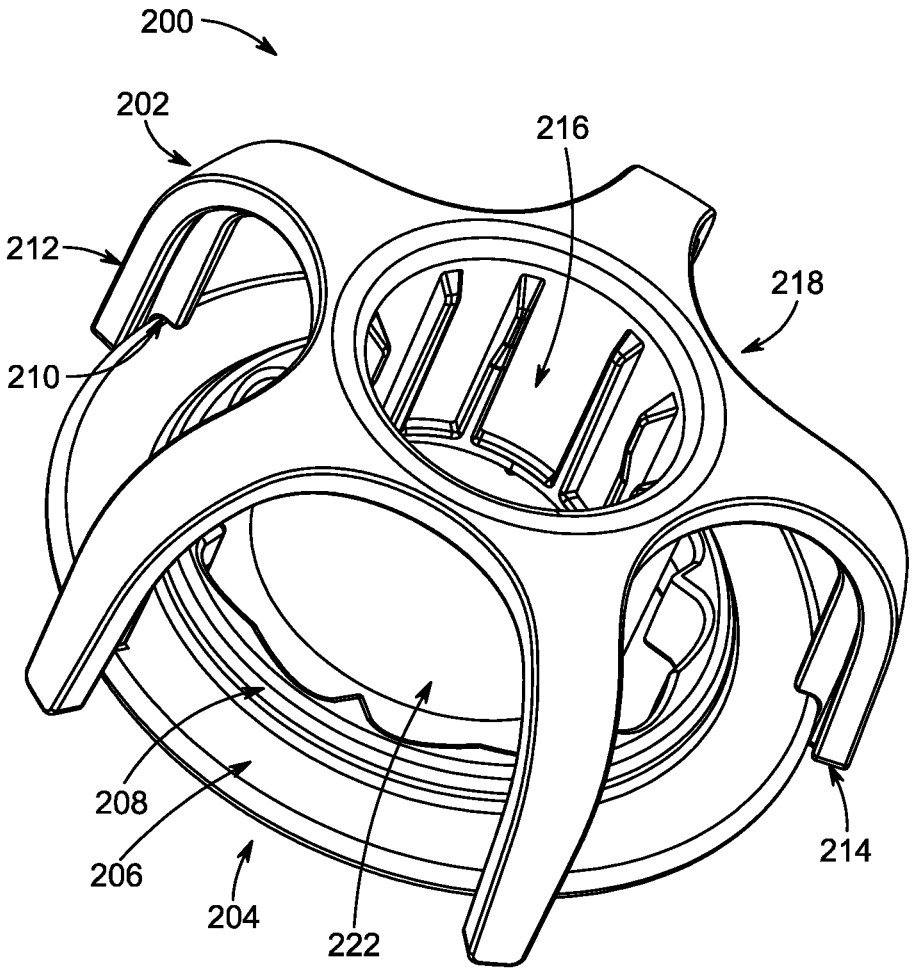
FIG. 5A is a top-side perspective view of another exemplary embodiment of a hair pod.
Figure 5B:
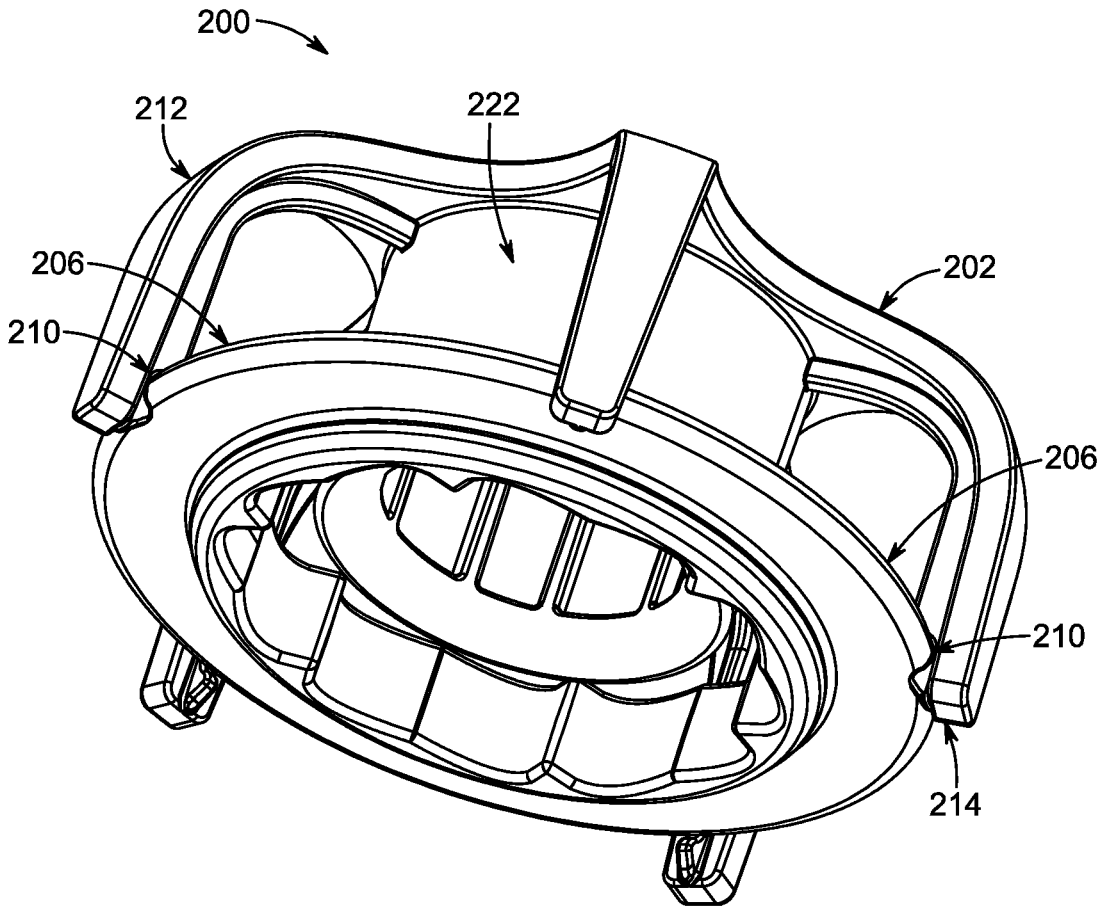
FIG. 5B is a bottom-side perspective view of the hair pod of FIG. 5A.
Figure 6:
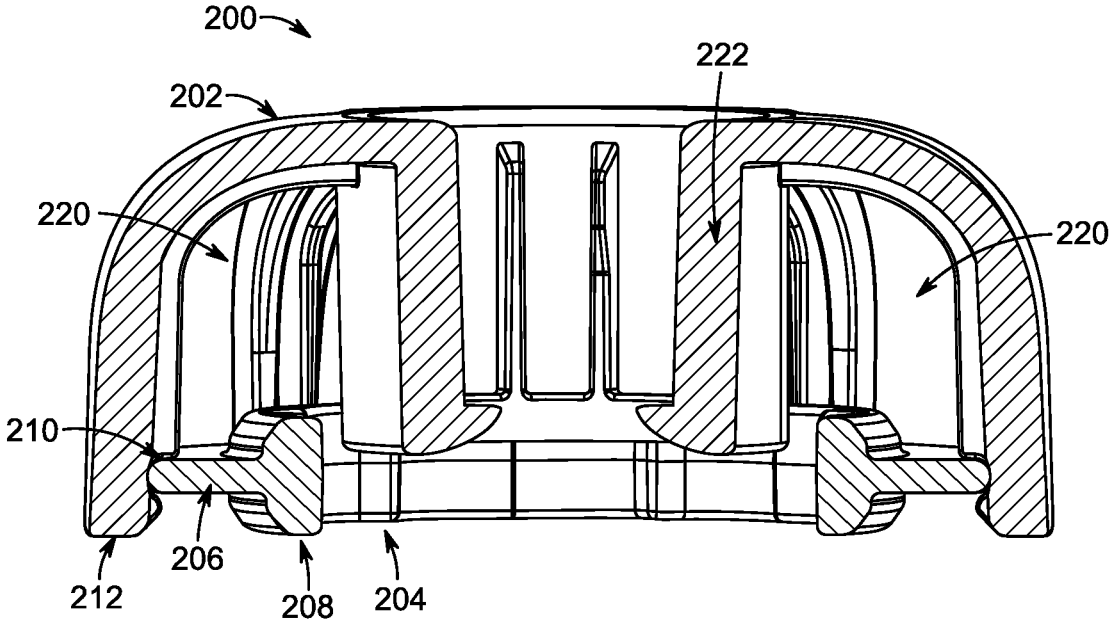
FIG. 6 is a cross-sectional view of the hair pod of FIGS. 5A-5B.

In another embodiment shown in FIGS. 5A-6, the hair pod 200 can have similar features performing similar functions as hair pod 100 described above, except where noted otherwise herein. For example, in this embodiment the base 204 of the hair pod 200 has a single flange 206 extending radially away from an annular collar 208. The flange 206 can lack flange projections, such as flange projections 148 shown in FIGS. 3A-3B. The cap 202 can include a plurality of arms 212 forming a shield 218 extending radially away from a central opening 216 of the cylindrical housing 222. Each arm 212 can include a notch 210 at a terminal end 214 of the arm 212. The flange 206 can be received within the notch 210 and the terminal end 214 can overhang the flange 206 as shown in FIGS. 5A-5B. When the base 204 and the cap 202 are coupled, the hair pod 200 can include an entrapment area 220 formed therebetween, as shown in FIG. 6. Hair can be wrapped around the cylindrical housing 222 within the entrapment area 220 to form curls in the hair.

Figure 7A:
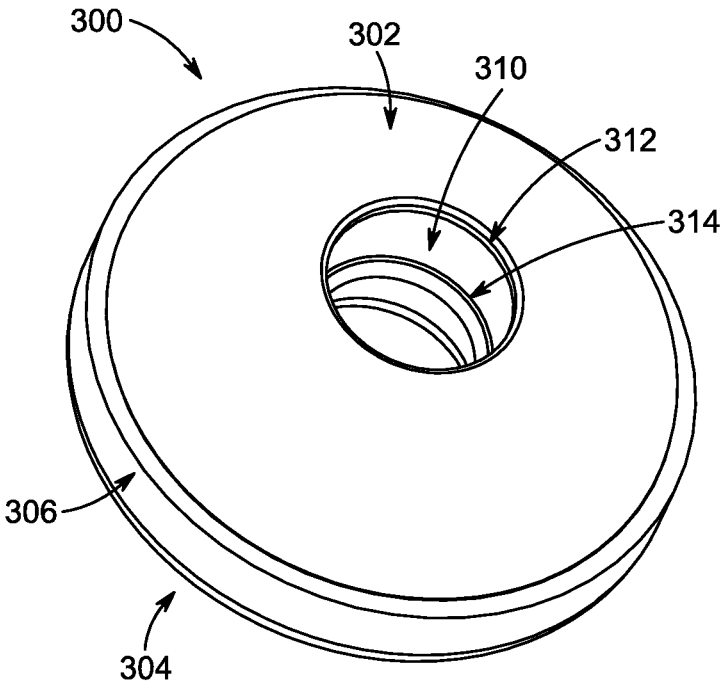
FIG. 7A is a top-side perspective view of another exemplary embodiment of a hair pod.
Figure 7B:
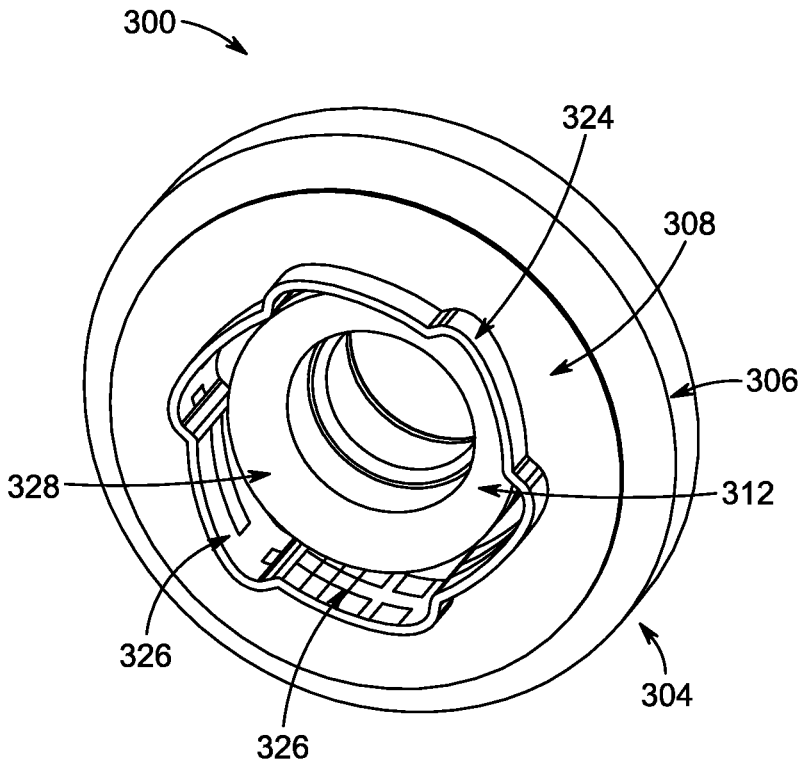
FIG. 7B is a bottom-side perspective view of the hair pod of FIG. 7A.
Figure 8:
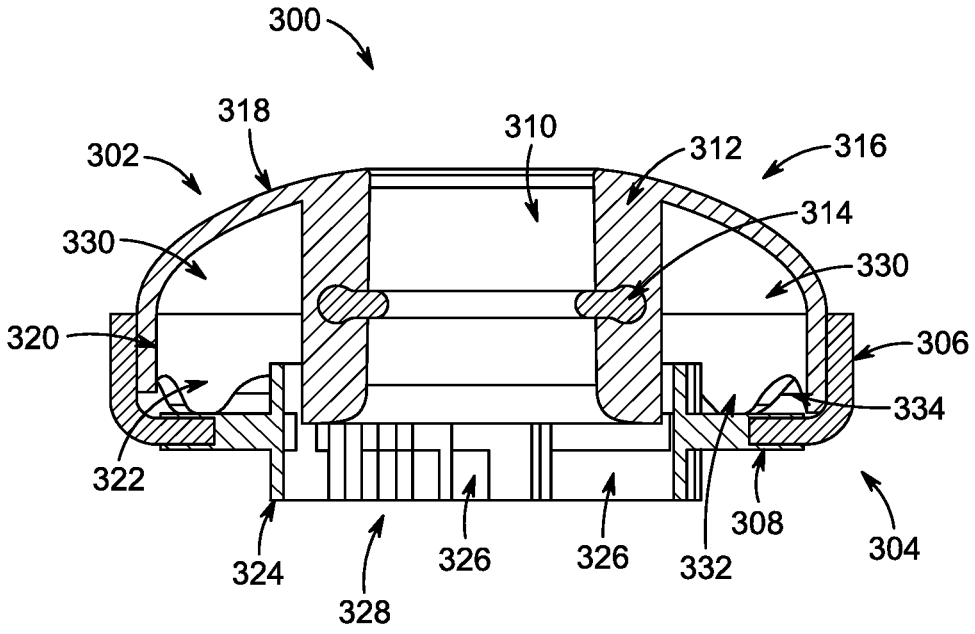
FIG. 8 is a cross-sectional view of the hair pod of FIGS. 7A-7B.

In another embodiment shown in FIGS. 7A-8, the hair pod 300 can include similar features performing similar functions as hair pod 100 described above, except where noted otherwise herein. For example, in this embodiment the hair pod 300 includes a cap 302 and a base 304. The cap 302 includes a cylindrical housing 312 with a central opening 310 extending therethrough. The cylindrical housing 312 can include a gasket 314 positioned on an inner wall of the cylindrical housing 312. The gasket 314 can be formed from or can include a high-friction material to retain the housing 312 on the end cap of a hair curler. In some embodiments, the high-friction material can be a thermoplastic elastomer. In some embodiments, the thermoplastic elastomer can have a Shore hardness of 55-65 on the durometer scale.

The cap 302 can include a shield 316 having a substantially concave shape and including a first portion 318 extending radially away from the housing 312 and a second portion 320 extending longitudinally from the first portion 318 as shown in FIG. 8. The second portion 320 can be received within the base 304 when the cap 302 is coupled with the base 304. An entrapment area 330 can be formed between the cap 302 and the base 304 as shown in FIG. 8. In some embodiments, the second portion 320 can include scalloped circumferential edge 322 to provide additional surface area for engaging a user's hair. The scallops can have a variety of protruding portions 332 interspersed between recessions 334. A variety of different arrangements and dimensions of the scallops along the edge 322 can be envisioned.

The base 304 can include a first flange 308 that extends radially from an annular collar 324 having a central opening 328 extending therethrough. The first flange 308 can be formed from a substantially rigid material and can be coupled with a second flange 306 extending radially away from the first flange 308. The second flange 306 can be formed from a substantially flexible material. In this way, the second flange 306 can be reversibly configured with respect to the first flange 308 to accommodate different rotational configurations of a hair curler, as well be described later. In some embodiments, the base 304 may not include a second flange 306 and the first flange 308 can extend radially away from the annular collar 324 as shown by the flange 406 in the base 404 shown in FIGS. 11 and 15. In these embodiments, the cap 402 can abut the upper surface 408 of the base 404 when coupled to the cap 402, as shown in configuration 2 of FIG. 15.

As shown in FIGS. 7B-9, the base 304 can also include a plurality of adjoining segments 326 defining the central opening 328 through the annular collar 324. The plurality of adjoining segments 326 can be configured to correspond to adjoining segments configured on a hair curler to which the base 304 can couple. The base 304 can be reversibly transformed from a first configuration associated with a hair curler with a first rotational direction to a second configuration associated with a hair curler having a second rotational direction that is opposite that of the first rotational configurations.

Figure 9A:
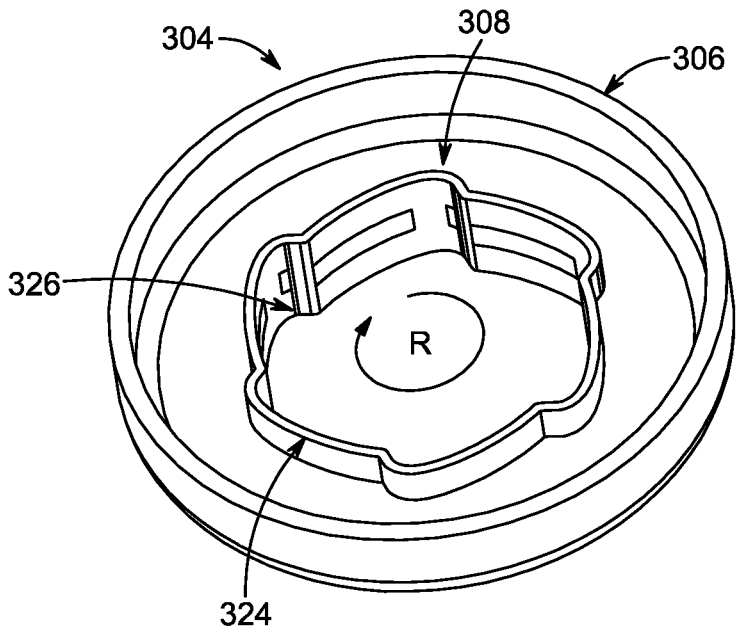
FIG. 9A is a top-perspective view of a base of the hair pod of FIGS. 7A-7B having a concave shape in a first configuration for mounting with a curler shaft having a first configuration.
Figure 9B:
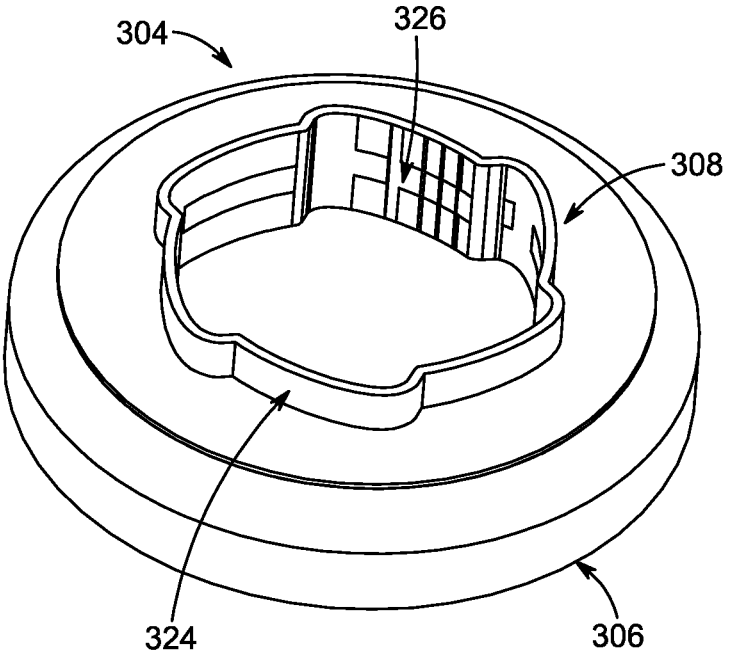
FIG. 9B is a top-perspective view of a base of the hair pod of FIGS. 7A-7B having a convex shape in a second configuration for mounting with a curler shaft having a second configuration.
Figure 9C:
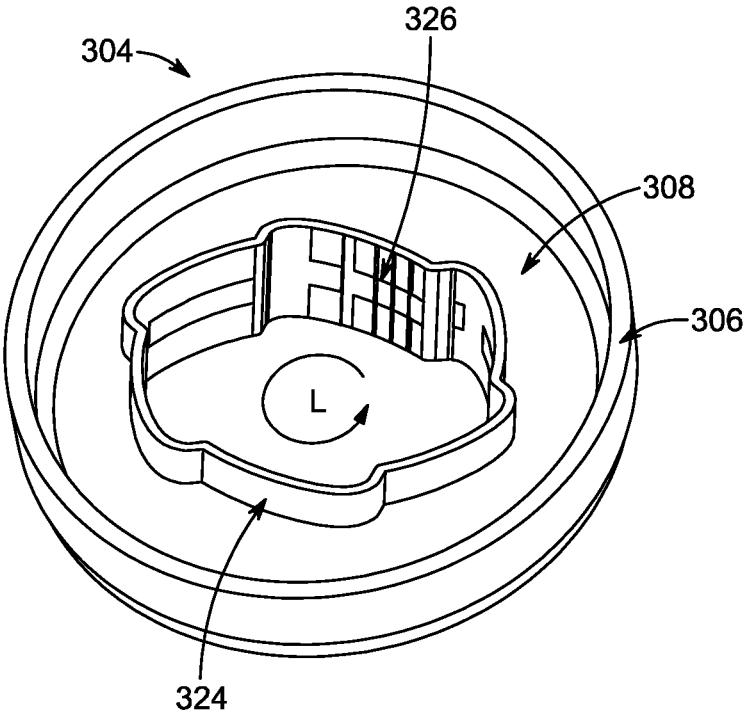
FIG. 9C is a top-perspective view of a base of the hair pod of FIGS. 7A-7B having a concave shape in the second configuration for mounting with the curler shaft having the second configuration.

For example, FIGS. 9A-9C illustrate a series of configurations of the base 304 as it is transformed from the first configuration (e.g., associated with a hair curler having a first rotational direction) to the second configuration (e.g., associated a hair curler having a second, opposite rotational direction. As shown in FIG. 9A, the base 304 and flange 306 can be configured for use with a hair curler having adjoining segments oriented in a first rotational configuration (R) for forming right handed curls. In this configuration the base has a concave shape. If a user desires to form left handed curls, the user can flip the base 304 over as shown in FIG. 9B. In this configuration the base 304 has a convex shape. Continuing from the configuration, the user can change the orientation of the second flange 306 by turning the second flange 306 upward to return the base 304 to a concave shape as shown in FIG. 9C. In this configuration, the base 304 and the flange 306 are now configured for use with a hair curler having adjoining segments oriented in a second rotational configuration (L) for forming left handed curls In combination with the reversible configuration of the second flange 306, the plurality of adjoining segments 326 can enable the hair pod 300 to be used with a hair curler having adjoining segments oriented in a first rotational direction (such as a hair curler having segments oriented in a right-handed or clockwise direction configured to produce right-handed curls) and a hair curler having adjoining segments oriented in a second rotational direction (such as a hair curler having segments oriented in a left-handed or counter-clockwise direction configured to produce left-handed curls). Advantageously, the arrangement of the adjoining segments 326 and the reversibility of the second flange 306 enables the hair pod 300 to be coupled ubiquitously with hair curlers having right and left-handed rotational directions without requiring separate hair pods with respective right and left-handed rotational directions. Thus, each hair pod 300 is configured to operate with rotationally different hair curlers thereby reducing the number of curling accessories needed by the user and improving the overall hair curling experience.

Figure 10:
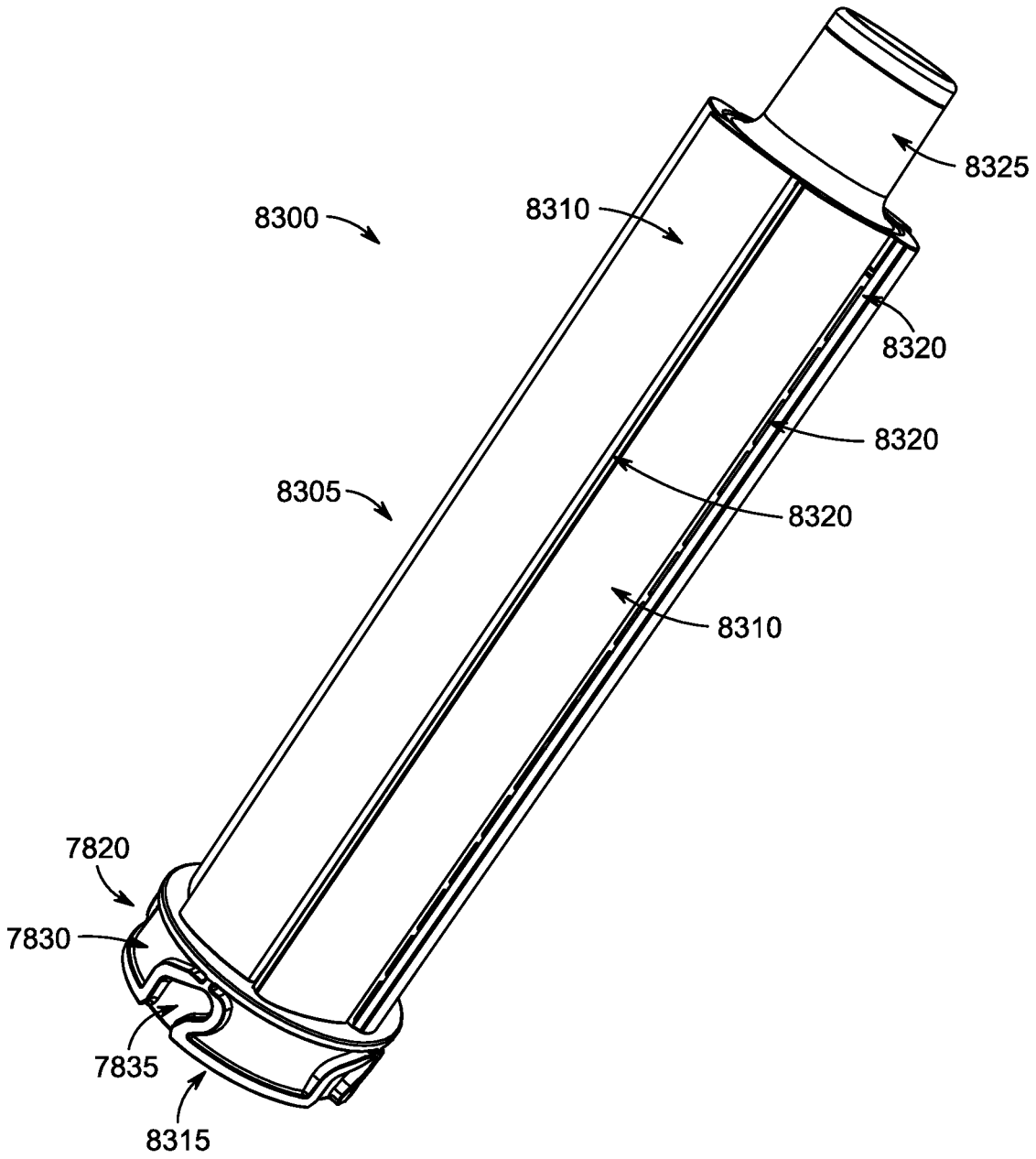
FIG. 10 is a side-perspective view of an exemplary embodiment of a hair curler configured for use with the hair pods described herein.

FIG. 10 shows one exemplary embodiment of a hair curler 8300 configured for use with the hair pods described herein. A person skilled in the art will appreciate that the hair pods can be used with various hair curler devices, and the central opening in the hair pod can be modified to have a shape that corresponds to a shape of the selected hair curler device. Accordingly, the hair curler of FIG. 10 is merely one embodiment. As shown, the hair curler 8300 includes a mating portion 7820 and a shaft 8305. In some embodiments, the hair curler 8300 can be coupled to a hair care appliance, such as a hair dryer, as an attachment. In some embodiments, the hair pods described herein can be configured for use with a standalone hair curler that is not an attachment to a hair care appliance. As shown in FIG. 10, an inlet 8315 can be provided in the mating portion 7820. A fluid flow path can be provided between the inlet 8315 and outlets 8320. The outlets 8320 can be provided between a plurality of adjoining segments 8310 of the hair curler 8300. The adjoining segments 8310 can extend along the central longitudinal axis of the hair curler 8300. The adjoining segments 8310 can be secured between an end cap 8325 and the mating portion 7820. The adjoining segments 8310 can be configured in a first rotational direction (e.g., a right-handed or clockwise direction) or a second rotational direction (e.g., a left-handed or counter-clockwise direction) relative to the central longitudinal axis of the hair curler 8300 so that hair can be curled in multiple rotational directions.

The fluid flow path exiting the outlets 8320 can provide a Coanda effect with respect to hair placed in proximity of the fluid flow and the hair curler 8300. The Coanda effect is the tendency of a fluid flow to emerge from an opening, such as the outlets 8320, and to follow an adjacent surface, such as the surfaces of the adjoining segments 8310 of the shaft 8305. Air from the surroundings can be entrained with the fluid flow exiting the outlets 8320 so that a region of lower pressure is developed adjacent to the surface of the adjoining segments 8310. Hair placed in proximity of the fluid flow path can thus be drawn toward the surface of the adjoining segments 8310 by virtue of the fluid flow existing the outlets 8320 and due to the Coanda effect produced by the fluid flow, thereby wrapping the hair around the shaft 8305. In some embodiments, the hair curler 8300 can include a heater assembly disposed within the shaft 8305. In some embodiments, the hair curler 8300 can include both a fluid flow path and a heater assembly disposed within the shaft 8305.

Figure 11:
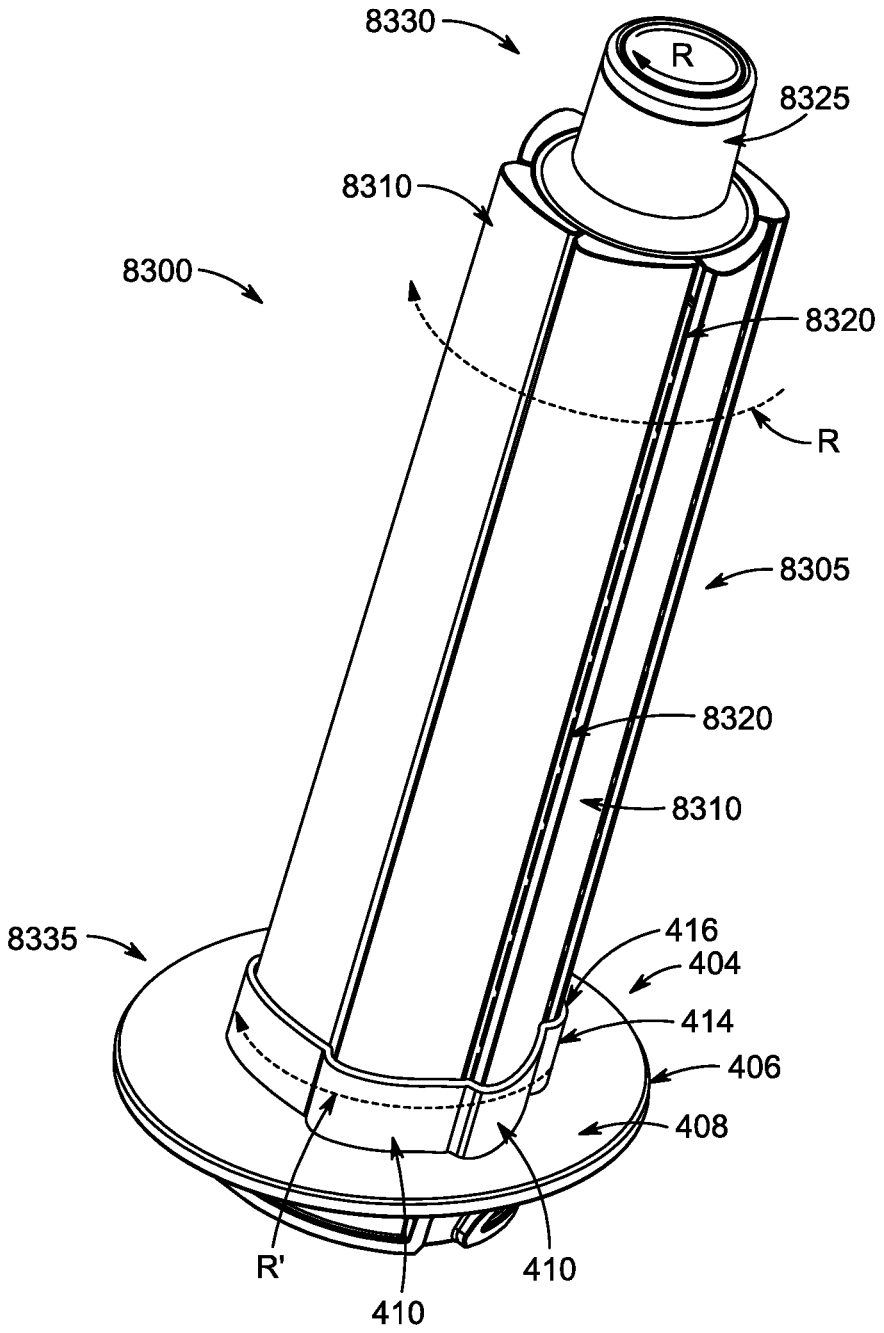
FIG. 11 is a side-perspective view of the hair curler of FIG. 10 with a base of a hair pod as described herein attached thereto.

A base of the hair pod described herein can be slidably received onto the shaft 8305 of the hair curler 8300 as shown in FIG. 11. For example, the base 404 can be slid over the end cap 8325 at the distal end 8330 of the hair curler 8300 and into position at the proximal end 8335 of the hair curler 8300. The base 404 can include a plurality of adjoining segments 410 that extend radially away from the annular collar 414 of the base 404. The plurality of adjoining segments 410 can have a rotational direction R' corresponding to the rotational direction R of the plurality of adjoining segments 8310 of the hair curler 8300. The rotational direction of the plurality of adjoining segments 8310 can correspond to the rotational direction of the fluid flow provided via the outlets 8320 so as to produce a fluid flow exhibiting the Coanda effect previously described. As shown the segments 8310 of the hair curler 8300 and the segments 410 of the base 404 are configured in a right-handed, clockwise rotational direction such that the generated curls will be right-handed curls.

With the base 404 positioned on the shaft 8305, a user can position a cap of the hair pod described herein onto the end cap 8325. The user can place the shaft 8305 in proximity of their hair at a desired curl location. As air is provided via the fluid flow path exiting outlets 8320, the Coanda effect produced by the fluid flow causes the hair to be drawn toward the shaft 8305 and to wrap around the shaft 8305 in a rotational direction corresponding to the direction of airflow and the rotational configuration of the curler (e.g., the rotational direction of the plurality of segments 8310). The user's hair will be continuously drawn toward the shaft 8305 from the desired curl location such that a substantial length of the user's hair extending from the desired curl location will wrap around the shaft 8305. With the user's hair wrapped around the shaft 8305, the base 404 can be advanced along the shaft 8305 toward the cap affixed to the end cap 8325 to capture the hair encircling the shaft 8305 between the cap and the base 404 (e.g., within the entrapment area of the hair pod). With the base 404 and cap coupled, the user can then remove the hair pod from the shaft 8300 such that the hair pod is retained in or on the user's hair. The user can leave the hair pod attached to their hair for a desired period of time to set the curl. The permanency of the curl can be increased by leaving the hair pod in the user's hair for longer periods of time.

Figure 12A:
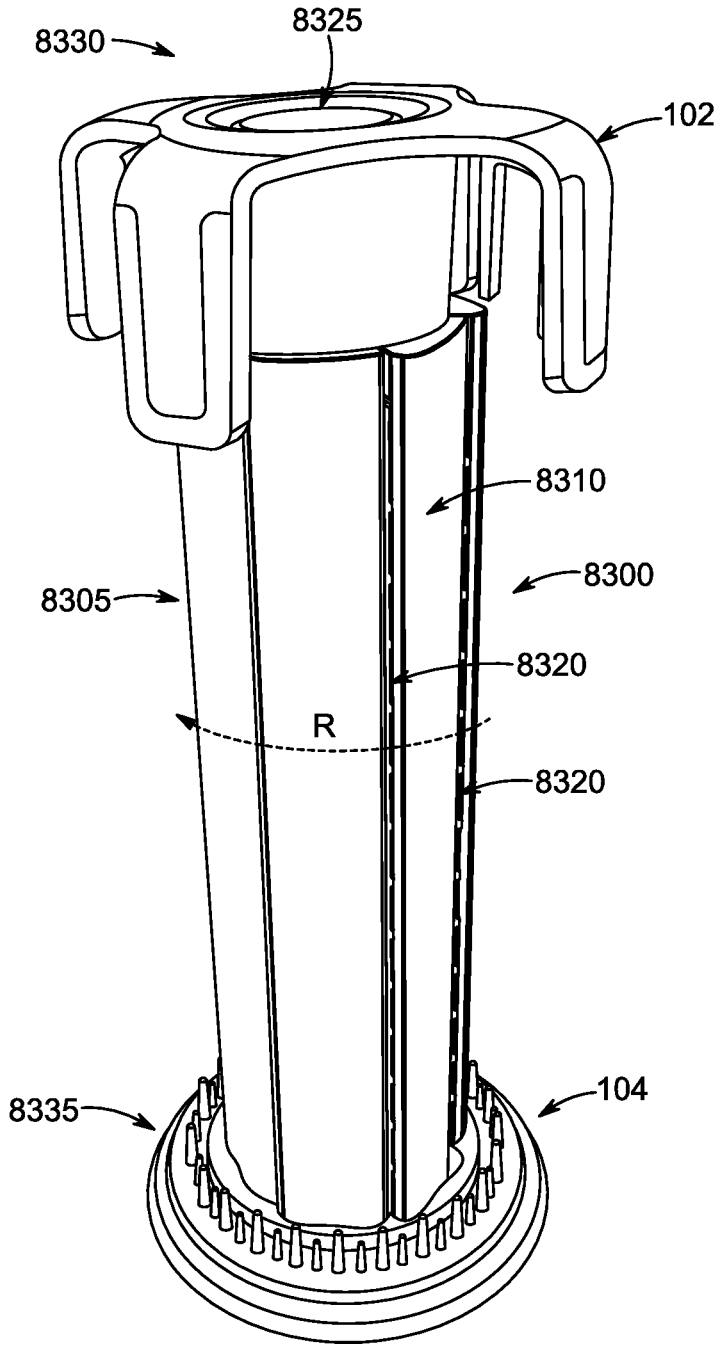
FIG. 12A is an image showing a side view of the hair pod of FIGS. 1A-1B attached to the hair curler of FIG. 10.
Figure 12B:
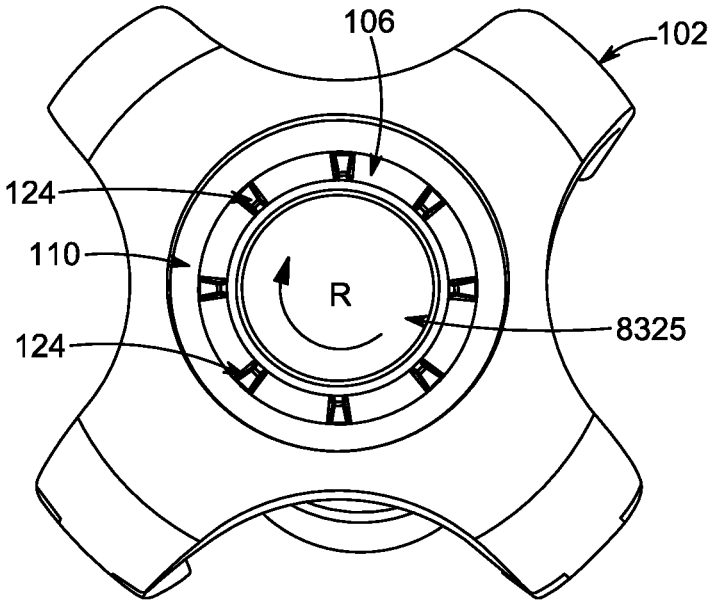
FIG. 12B is an image showing a top view of a cap of the hair pod of FIGS. 1A-1B attached to the hair curler of FIG. 10.
Figure 13:
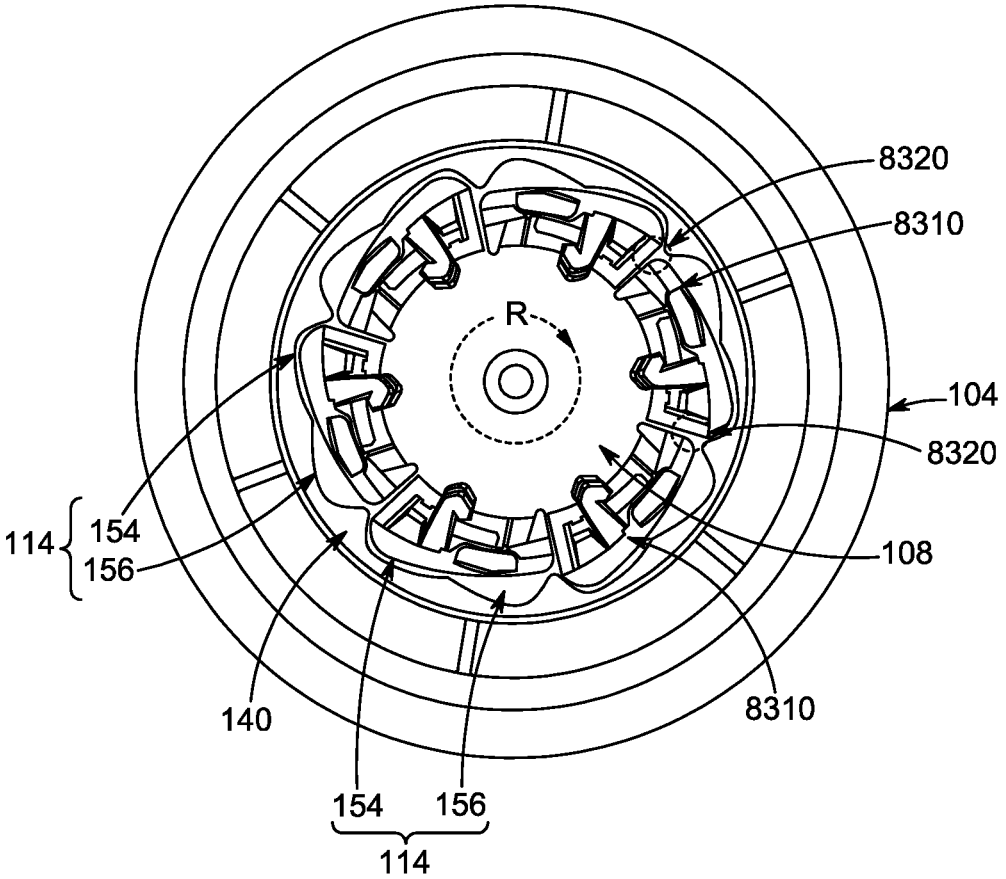
FIG. 13 is an image showing a bottom view of a base of the hair pod of FIGS. 1A-1B attached to the hair curler of FIG. 10.
Figure 14:
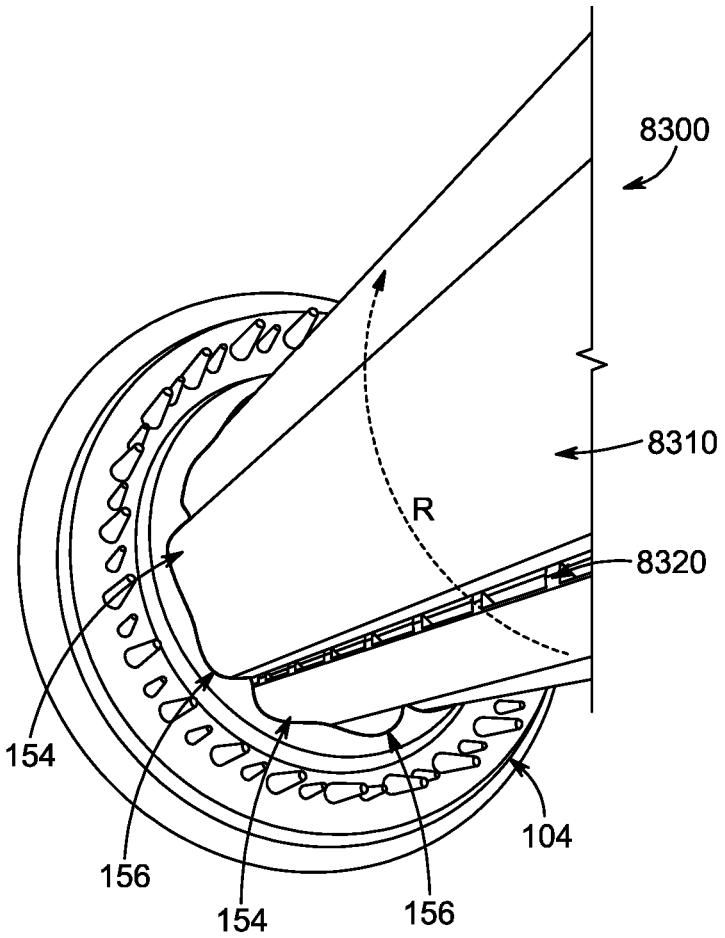
FIG. 14 is an image showing a side perspective view of a base of the hair pod of FIGS. 1A-1B attached to the hair curler of FIG. 10.

In another embodiment, shown in the images of FIG. 12A-14, the hair pod 100 described in relation to FIGS. 1A-4 is shown coupled to the hair curler 8300. As shown in FIGS. 12A-14, the hair curler 8300 is configured with a right-handed (R) rotational direction. The base 104 can be slid onto the shaft 8305 by passing the end cap 8325 through the central opening 108 such that the base 108 slides along the shaft 8305 from the distal end 8330 of the shaft 8305 to the proximal end 8335 as shown in FIGS. 12A, 13 and 14. Subsequently, the cap 102 can be slid onto the end cap 8325 of the hair curler 8300 such that the end cap 8325 extends into the central opening 106 of the cap 102 and is secured in place via ribs 124 extending radially inward from the cylindrical housing 110 as shown in FIGS. 12A-12B.

As shown in bottom view of FIG. 13, the base 104 includes a plurality of adjoining segments 114 configured on the annular collar 140. The plurality of adjoining segments can include a first set of adjoining segments 154 and a second set of adjoining segments 156 that are interspersed between the first set of segments 154. The first set of adjoining segments 154 are configured to engage with the adjoining segments 8310 of the hair curler 8300 which have a right-handed or clockwise (R) rotational direction. The second set of adjoining segments 156 can be configured for engaging adjoining segments of a hair curler having a left-handed or counter-clockwise rotational direction. Thus, the second set of adjoining segments 156 are not coupled to the segments 8310 since the hair curler 8300 is not configured in a left-handed or clockwise rotational direction. As shown in the close-up view of 14, the segments 8310 mate with the first set of segments 154 to secure the base 104 onto the shaft 8305 of the hair curler 8300 for producing curls having a right-handed or clockwise rotational direction. The segments 8310 do not mate with the second set of adjoining segments 156 since the rotational direction (R) of the segments 8310 correspond to the rotational direction of the first set of adjoining segments 154 and not the rotational direction of the second set of adjoining segments 156.

Figure 15A:
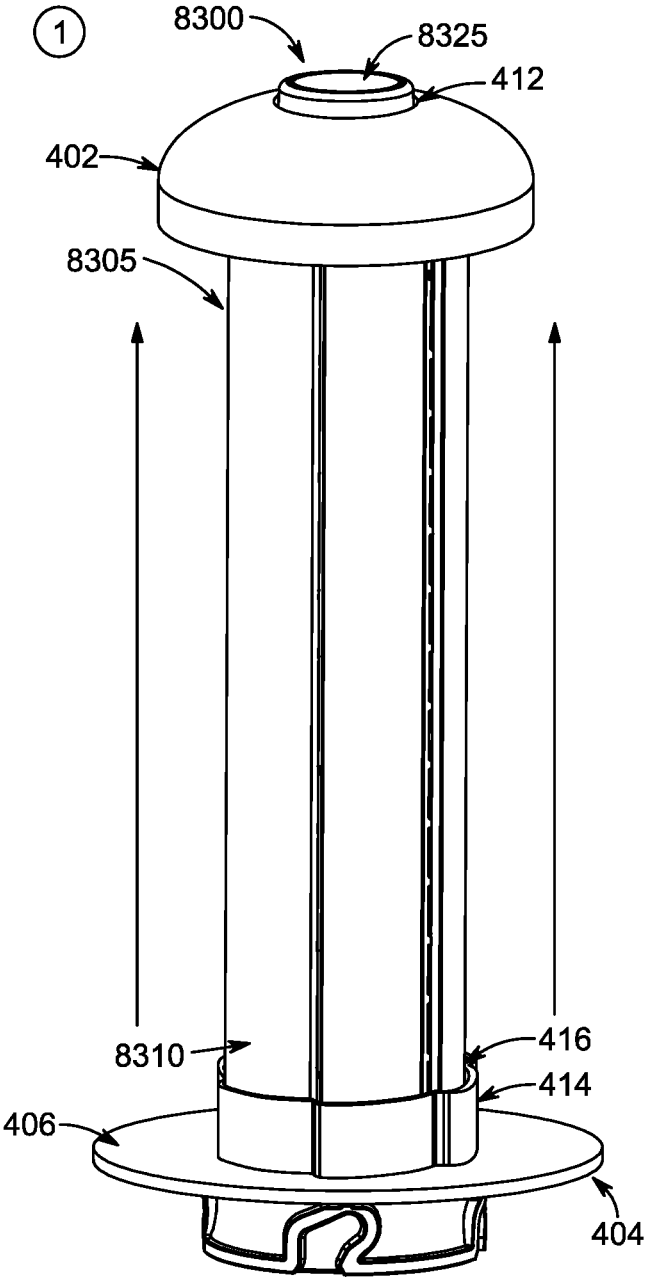
FIG. 15A illustrates a first configuration of the hair pod of FIGS. 7A-7B during uncoupling from the hair curler of FIG. 10.
Figure 15B:
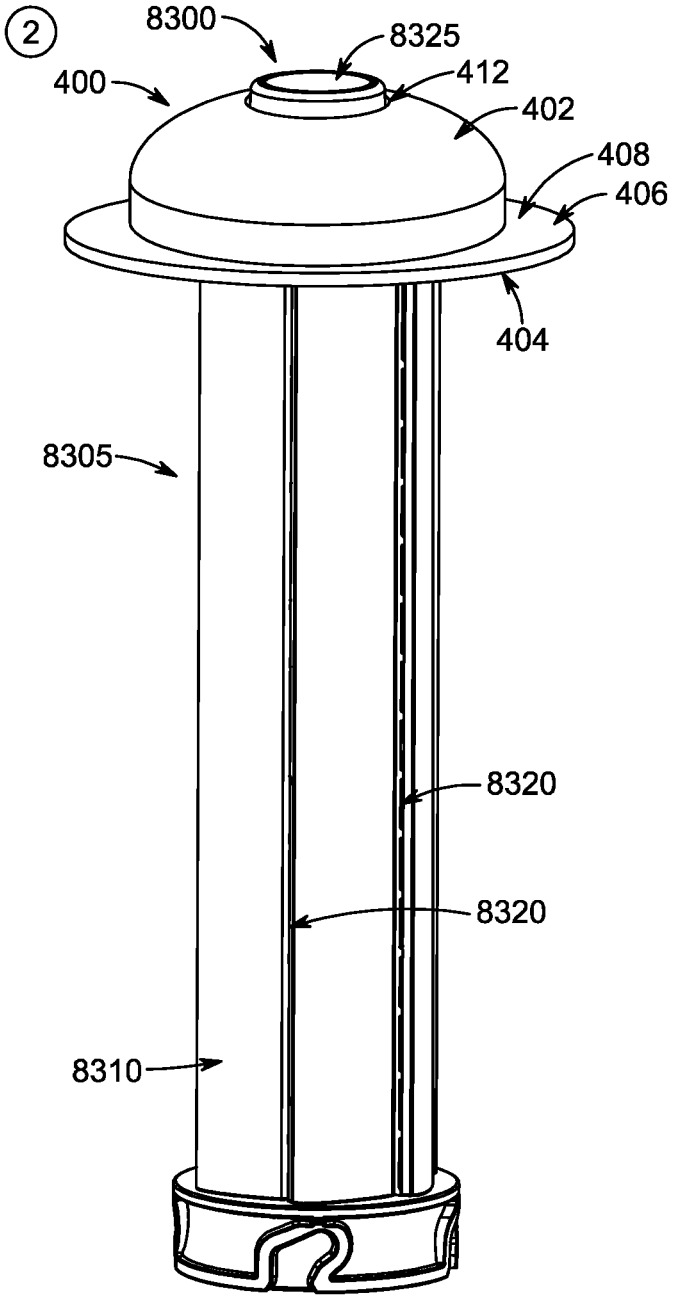
FIG. 15B illustrates a second configuration of the hair pod of FIGS. 7A-7B during uncoupling from the hair curler of FIG. 10.
Figure 15C:
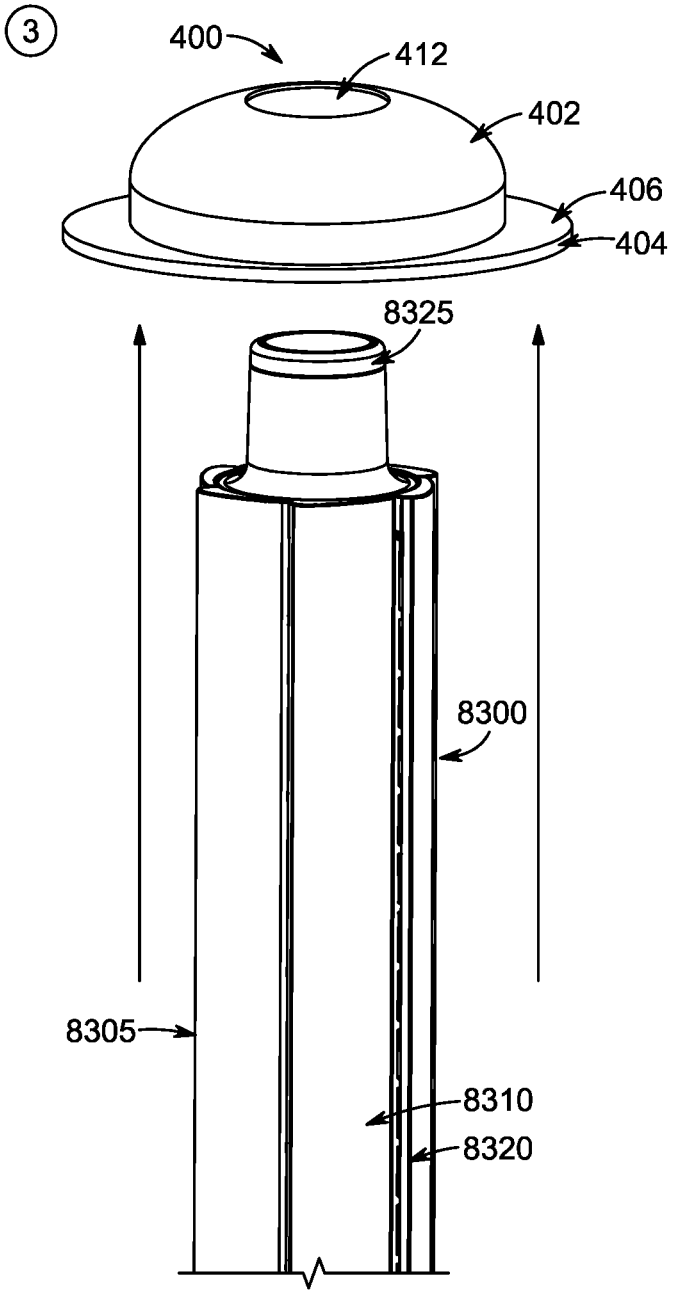
FIG. 15C illustrates a third configuration of the hair pod of FIGS. 7A-7B during uncoupling from the hair curler of FIG. 10.
Figure 16:
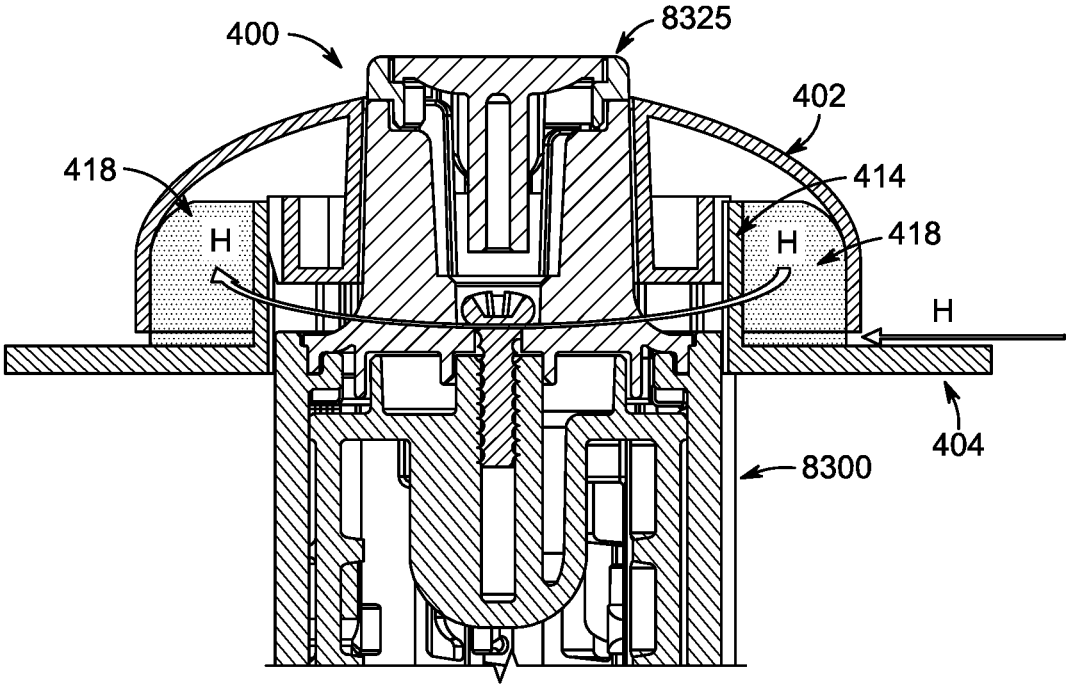
FIG. 16 is a cross-sectional view of the hair pod of FIGS. 7A-7B attached to an end of the hair curler of FIG. 10.

In use, a user can configure the base 404 and cap 402 of a hair pod 400 onto a hair curler 8300 as shown in FIG. 15A. The base 404 can be slid over the shaft 8305 via the central opening 416 extending through the annular collar 414 of the base 404. The cap 402 can be slid onto the end cap 8235 of the hair curler 8300 via the central opening 412 of the cap 402. With the base 404 and cap 402 coupled to the hair curler 8300 as illustrated in FIG. 15A, a user can curl their hair by activating the device to cause air to flow from the curler, thereby causing the user's hair to be wrapped around the shaft 8305. Once the hair is fully wrapped around the shaft 8305 between the base 404 and the cap 402, the base 404 can be advanced from a first position shown in FIG. 15A, along the shaft 8305 toward the cap 402 until the upper surface 408 of the base 404 engages with the cap 402 in a second position as shown in FIG. 15B. A cross-sectional view of the hair pod 400 is shown in FIG. 16 illustrating the hair H wrapped around the annular collar 414 and retained within the entrapment area 418. Returning to FIG. 15B, with the user's hair retained within the entrapment area 418 defined by the chamber formed between the base 404 and the cap 402, the user can remove the hair pod 400 from the hair curler 8300 by sliding the hair pod 400 over the end cap 8325 of the hair curler 8300 as shown in FIG. 15C. The user can leave the hair pod 400 in place for period of time to set the curl in their hair.

The improved hair pods and styling assemblies described herein produce a number of advantages. For example, the use of multiple configurations sets of adjoining segments defining the central opening of the base allow the hair pod to be used with hair curlers having a right-handed rotational direction and a left-handed rotational direction, thus eliminating the need for hair pods that are specifically configured for right-handed and left-handed rotational directions. The convenient interference or friction fit provided between the base and the cap make the hair pod easier to manipulate to secure hair within the entrapment area of the hair pod. The use of high-friction materials on the cylindrical housing and portions of the shield of the cap improve the retention of hair within the hair pod and increase the retention of the hair pod on a user's hair. As a result of these features, the hair pods and styling assemblies described herein can create tighter and more well-formed curls along an entire length of the user's hair, remain more securely attached to the user's hair, and provided improved handling for easier handling than existing hair curling devices resulting in an overall improved experience for curling hair.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A hair pod, comprising:

a cap having a central opening extending therethrough and a shield arranged around the central opening, the shield having a first portion extending radially outward from the central opening and a second portion extending substantially parallel to a longitudinal axis of the central opening such that the first and second portions define an entrapment area;

a base having an annular collar defining a central opening of the base, the annular collar having a plurality of asymmetric arcuate segments extending therearound to form an irregularly shaped circumference of the central opening of the base and a flange extending radially from each of the plurality of asymmetric arcuate segments, the flange configured to mate with the shield such that the base and the cap enclose the entrapment area and such that the central opening in the cap is aligned with the central opening in the base.

2. The hair pod of claim 1, wherein the cap includes a cylindrical housing defining the central opening, the cylindrical housing extending into the entrapment area.

3. The hair pod of claim 2, wherein the cylindrical housing comprises a gasket positioned on an inner wall of the cylindrical housing.

4. The hair pod of claim 1, wherein the shield is configured to extend around and frictionally engage an inner surface of the flange.

5. The hair pod of claim 1, wherein the plurality of asymmetric arcuate segments are adjoining segments.

6. The hair pod of claim 5, wherein the adjoining segments project above and below the flange.

7. The hair pod of claim 1, wherein the central opening is configured to receive an end of a hair curling apparatus.

8. The hair pod of claim 1, wherein the first portion of the shield has a concave cross-sectional profile relative to the longitudinal axis of the central opening.

9. The hair pod of claim 1, wherein the shield comprises a first side including the central opening, and a second side opposite the first side of the shield and facing the entrapment area, and the flange includes a first side facing the entrapment area, a second side opposite the first side of the flange, a first flange portion extending from the annular collar, and a second flange portion extending from the first flange portion.

10. The hair pod of claim 9, wherein the first flange portion includes a rigid material and the second flange portion includes a flexible material.

11. The hair pod of claim 9, wherein the second portion of the shield is received within the second flange portion such that the first side of the shield frictionally engages the first side of the flange.

12. The hair pod of claim 9, wherein the second flange portion is reversibly configurable with respect to a rotational configuration of a hair curler configured to receive the hair pod thereon.

13. A hair curling apparatus, comprising:

a cap releasably mateable with a base to form an entrapment area therein for curling hair, the cap including a shield defining the entrapment area and a cylindrical sleeve extending from the shield and disposed within the entrapment area, the cylindrical sleeve having a first end including a central opening and a second end received within an interior of an annular collar of the base, the annular collar positioned centrally within a flange of the base and including a plurality of asymmetric arcuate segments extending circumferentially around the annular collar such that a first portion of a first asymmetric arcuate segment is radially offset from a second portion of a second asymmetric arcuate segment adjacent to the first portion of the first asymmetric arcuate segment, the annular collar configured to slidably engage a shaft of a hair curler.

14. The hair curling apparatus of claim 13, wherein an inner surface of the cylindrical sleeve includes a gasket extending therearound and positioned between the first and second ends, the gasket having a Shore hardness between 55-65.

15. The hair curling apparatus of claim 13, wherein the cap includes a concave first portion and a linear second portion positioned distally to the concave first portion, the linear second portion extending parallel to the cylindrical sleeve.

16. The hair curling apparatus of claim 15, wherein a distal end of the linear second portion of the cap includes a plurality of protrusions and recessions extending there along forming a scalloped edge of the linear second portion.

17. The hair curling apparatus of claim 13, wherein the flange includes a first rigid portion adjacent to the annular collar and a second flexible portion adjacent to the first rigid portion, the second flexible portion being reversible between first and second flange positions.

18. The hair curling apparatus of claim 17, wherein the first flange position corresponds to a first rotational orientation of the shaft of the hair curler and the second flange position corresponds to a second rotational orientation of the shaft of the hair curler opposite the first rotational orientation.

19. The hair curling apparatus of claim 17, wherein the first flange position is configured to curl hair within the entrapment area in a clockwise rotational direction and the second flange position is configured to curl hair within the entrapment area in a counter-clockwise rotational direction.

20. The hair curling apparatus of claim 13, wherein the plurality of asymmetric arcuate segments of the annular collar protrude above and below the flange.

21. The hair curling apparatus of 13, wherein each segment of the plurality of asymmetric arcuate segments is asymmetrically curved along its length.

* * * * *